US006220265B1

(12) United States Patent
Zheng

(10) Patent No.: US 6,220,265 B1
(45) Date of Patent: Apr. 24, 2001

(54) ADJUSTABLE COLLAPSIBLE PANELS

(75) Inventor: Yu Zheng, Covina, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 09/245,582

(22) Filed: Feb. 5, 1999

Related U.S. Application Data

(63) Continuation-in-part of application No. 09/152,755, filed on Sep. 14, 1998, now Pat. No. 6,073,643.

(51) Int. Cl.[7] ..... E04H 15/40

(52) U.S. Cl. ..... 135/125; 52/63; 52/71; 135/128; 135/144; 135/147

(58) Field of Search ..... 52/63, 65, 71, 52/222; 135/97, 117, 125, 128, 130, 137, 144, 147

(56) References Cited

U.S. PATENT DOCUMENTS

| | | | | |
|---|---|---|---|---|
| 5,301,705 | * | 4/1994 | Zheng | 135/128 X |
| 5,467,794 | * | 11/1995 | Zheng | 135/130 X |
| 5,560,385 | | 10/1996 | Zheng . | |
| 5,579,799 | * | 12/1996 | Zheng | 135/130 X |
| 5,664,596 | * | 9/1997 | Zheng | 135/130 X |
| 5,722,446 | | 3/1998 | Zheng . | |
| 5,778,915 | * | 7/1998 | Zheng | 135/125 X |
| 5,816,279 | * | 10/1998 | Zheng | 135/130 X |
| 5,816,954 | * | 10/1998 | Zheng | 135/125 X |
| 5,941,265 | * | 8/1999 | Zheng | 135/128 X |
| 5,975,101 | * | 11/1999 | Zheng | 135/130 X |
| 6,006,772 | * | 12/1999 | Zheng | 135/137 X |
| 6,030,300 | * | 2/2000 | Zheng | 135/125 X |
| 6,032,685 | * | 3/2000 | Zheng | 135/128 X |
| 6,073,643 | * | 6/2000 | Zheng | 135/144 X |

* cited by examiner

*Primary Examiner*—Carl D. Friedman
*Assistant Examiner*—Kevin D. Wilkens
(74) *Attorney, Agent, or Firm*—Raymond Sun

(57) ABSTRACT

Collapsible structures include at least first and second panels, each panel having a foldable frame member that has a folded and an unfolded orientation, and a material covering portions of the frame member when the frame member is in the unfolded orientation. The first panel has a first retaining mechanism that defines an adjustment space, and the second panel has a second retaining mechanism that is movably received inside the adjustment space of the first retaining mechanism to couple the second panel to the first panel. The second retaining mechanism is movable within the adjustment space to allow the relative positions of the first and second panels to be adjusted. Other collapsible structures include at least first and second panels, each panel having a foldable frame member that has a folded and an unfolded orientation, and a material covering portions of the frame member when the frame member is in the unfolded orientation. A connector couples the first and second panels in a manner that allows the relative positions of the first and second panels to be adjusted.

18 Claims, 22 Drawing Sheets

ADJUSTABLE COLLAPSIBLE PANELS

RELATED CASES

This is a continuation-in-part of Ser. No. 09/152,755, entitled "Adjustable Collapsible Panels", filed Sep. 14, 1998 now U.S. Pat. No. 6,073,643.

BACKGROUND OF THE INVENTION

1. Field of the Invention

The present invention relates to collapsible structures, and in particular, to collapsible structures having panels whose position with respect to adjacent panels can be adjusted.

2. Description of the Prior Art

Collapsible objects have recently become popular with both adults and children. Examples of such collapsible objects are shown and described in U.S. Pat. Nos. 5,467,794 (Zheng) and 5,560,385 (Zheng) in the form of collapsible structures. These structures have a plurality of panels which may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Another example of a collapsible structure include collapsible sunshields, such as illustrated in U.S. Pat. No. 4,815,784 (Zheng). These sunshields have two interconnecting panels that span the width of the windscreen.

All of the above-mentioned collapsible structures have two or more panels, each of which is hingedly or otherwise coupled to one or more adjacent panels. While these collapsible structures enjoy the numerous benefits described above, their size and configuration are generally fixed and cannot be adjusted. For example, the collapsible structure shown in FIG. 1 of U.S. Pat. No. 5,560,385 has a top fabric that is attached to the four panels, and which cannot be removed without cutting or otherwise destroying the top fabric. As another example, the sunshield shown in FIG. 1 of U.S. Pat. No. 4,815,784 has a predetermined width, with the interconnecting fabric providing a small amount of slack to adjust the width of the sunshield. However, the width cannot be made longer or shorter to adapt the sunshield to be fitted against windscreens of varying sizes.

Thus, there still remains a need to provide collapsible objects and structures having multiple panels, where the positions of these panels can be adjusted with respect to each other, to increase the variety of play and the useful applications of these objects and structures.

SUMMARY OF THE DISCLOSURE

It is an object of the present invention to provide a collapsible structure or object having at least two panels whose positions with respect to each other can be adjusted.

It is another object of the present invention to provide a collapsible sunshield or divider, having at least two panels, whose overall width or length can be adjusted.

It is a further object of the present invention to provide a collapsible structure having at least two panels, where the position of one of the panels can be adjusted with respect to the other panels to provide increased variety in use.

In order to accomplish the objects of the present invention, in one embodiment, the collapsible structures according to the present invention have at least first and second panels, each panel having a foldable frame member that has a folded and an unfolded orientation, and a material covering portions of the frame member when the frame member is in the unfolded orientation, with the material assuming the unfolded orientation of its associated frame member. The first panel has a first retaining mechanism that defines an adjustment space, and the second panel has a second retaining mechanism that is movably received inside the adjustment space of the first retaining mechanism to couple the second panel to the first panel. The second retaining mechanism is movable within the adjustment space to allow the relative positions of the first and second panels to be adjusted.

In another embodiment according to the present invention, the collapsible structures according to the present invention have at least first and second panels, each panel having a foldable frame member that has a folded and an unfolded orientation, and a material covering portions of the frame member when the frame member is in the unfolded orientation, with the material assuming the unfolded orientation of its associated frame member. A connector is provided that couples the first and second panels in a manner that allows the relative positions of the first and second panels to be adjusted.

The collapsible structures according to the present invention are convenient for use since they can be easily and quickly folded and collapsed into a smaller size for transportation and storage. More importantly, the panels allow relative positions of the panels to be adjusted to change the size and configuration of the object or structure. This increases the number of applications in which the collapsible objects and structures can be used, and adds to the fun and variety of these objects and structures.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible objects and structures having at least two panels whose positions with respect to each other can be adjusted. The principles of the present invention can be applied to collapsible objects and structures such as, but not limited to, sunshields, dividers, partitions, play structures, shelters, tents, cabanas, displays, cabinets, or the like.

Figure 1:
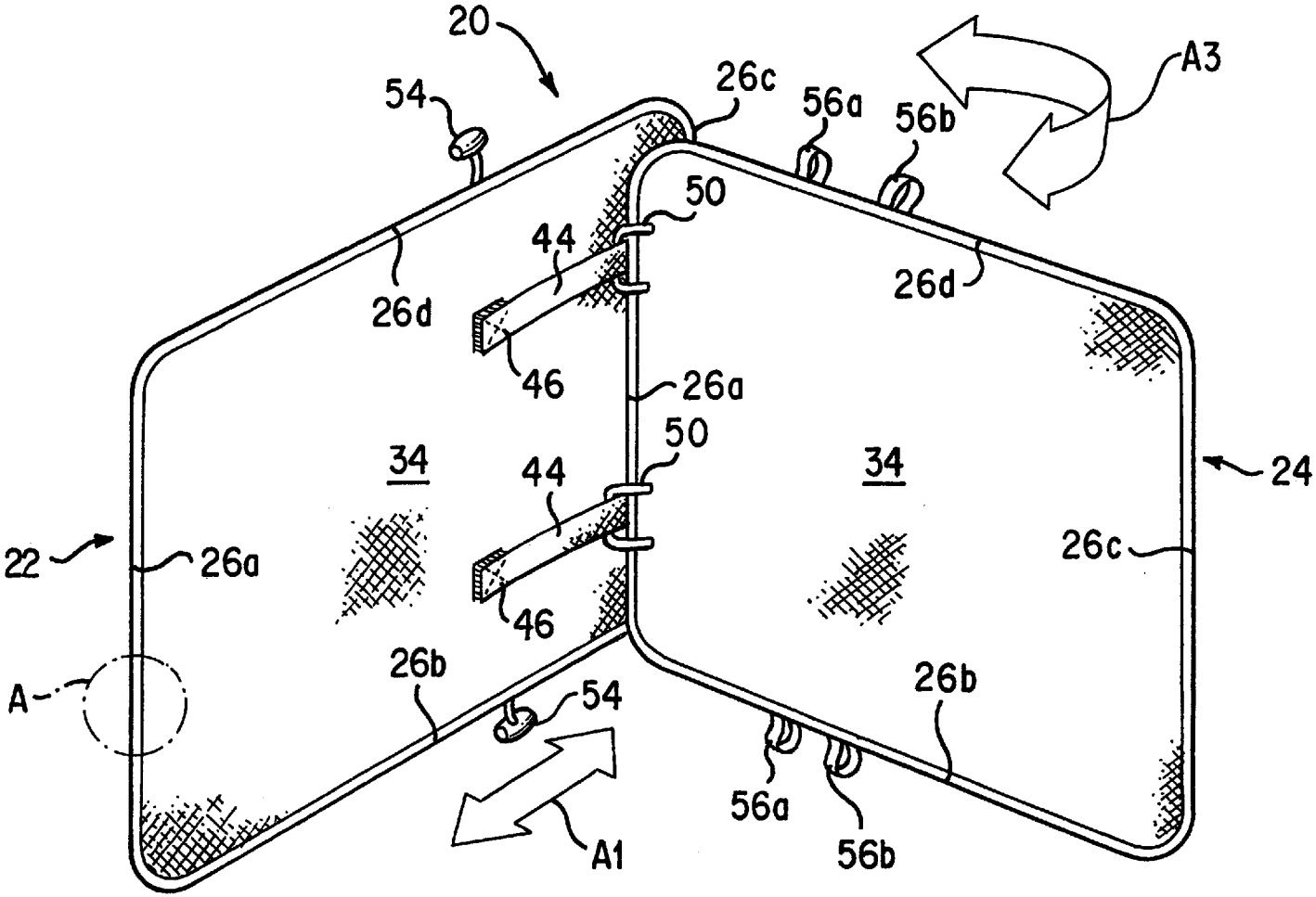
FIG. 1 is a perspective view of a collapsible object according to one embodiment of the present invention shown in use in its expanded configuration.
Figure 2:
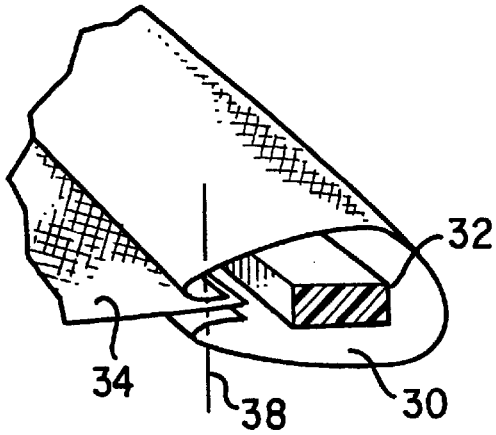
FIG. 2 is a partial cut-away view of the section A of the object of FIG. 1 illustrating a frame member retained within a sleeve.

FIGS. 1 and 2 illustrate a collapsible object 20 that embodies the underlying principles of the present invention. Referring to FIG. 1, the object 20 has two separate panels 22 and 24 that are coupled together by the adjustable attachment mechanisms (described below) of the present invention. The panels 22 and 24 can assume any configuration, such as circular, oval, rectangular (as shown), square, trapezoidal, or irregular. The panel 22 has four side edges, a left side edge 26*a*, a bottom side edge 26*b*, a right side edge 26*c*, and a top side edge 26*d*. Referring also to FIG. 2, the panel 22 has a continuous frame retaining sleeve 30 provided along and traversing the four edges of its four sides. A continuous frame member 32 is retained or held within the frame retaining sleeve 30 to support panel 22. The panel 24 can have the same structure as panel 22.

The continuous frame member 32 of each panel 22, 24 may be provided as one continuous loop, or may be a strip of material connected at both ends to form a continuous loop. The frame members 32 are preferably formed of flexible coilable steel, although other materials such as plastics may also be used. The frame members 32 should be made of a material which is relatively strong and yet is flexible to a sufficient degree to allow it to be coiled. Thus, each frame member 32 is capable of assuming two positions, an open or expanded position such as shown in FIG. 1, or a folded position in which the frame member is collapsed into a size which is much smaller than its open position (see FIG. 5D).

The frame members 32 may be merely retained within the respective frame retaining sleeve 30 without being connected thereto. Alternatively, the frame retaining sleeves 30 may be mechanically fastened, stitched, fused, or glued to the respective frame members 32 to retain them in position.

Fabric or sheet material 34 extends across each panel 22, 24, and is held taut by the respective frame members 32 when each panel is in its open position. The term fabric is to be given its broadest meaning and should be made from strong, lightweight materials and may include woven fabrics, sheet fabrics or even films. The type of fabric used will depend on the intended application. For example, a stronger and more durable fabric will be used if the structure is intended for use as a divider, or when used for the collapsible structures described in connection with FIGS. 6–8 and 16D–19 below. Alternatively, when the object 20 is used as a sunshield, the fabric can be a sheet material having a reflective surface on one side to reflect heat and sunlight. The fabric should be water-resistant and durable to withstand the wear and tear associated with rugged outdoor use or rough treatment by children and adults. The fabric can extend across selected portions of, or the entire area, of the panels 22, 24.

As illustrated best in FIG. 2, the frame retaining sleeve 30 may be attached to the fabric material 34 along the side edges 26*a*–26*d* of the panels 22, 24. Specifically, the fabric material 34 can be attached to the frame retaining sleeve 30 by applying a stitching 38 that extends along the side edges

26*a*–26*d*. The stitching 38 can also operate to enclose the frame retaining sleeve 30. Alternatively, the frame retaining sleeve 30 can be a part of or an extension of the fabric material 34, where the side edge of the fabric material 34 is wrapped around the frame member 32 to enclose the frame member 32, and then the stitching 38 applied to enclose the sleeve 30.

The panels 22, 24 are provided with interacting (i.e., inter-engaging) and corresponding adjustable attachment mechanisms that function both to couple or attach the panels 22, 24 to each other, and to allow relative positions of the panels 22, 24 to be adjusted to change the size and configuration of the object 20. Specifically, the panel 22 has one or more elongated straps 44, each having opposite ends 46 and 48 (see FIG. 4) that are stitched, sewn or otherwise attached to the fabric material 34 of the panel 22. The other panel 24 has one or more corresponding loops 50 that are sewn or otherwise attached to the fabric material 34 of the panel 24. Each loop 50 is held inside the space (also referred to as "adjustment space") between its corresponding strap 44 and the fabric material 34 of the panel 22, and is adapted to slide along the length of the strap 44 between the opposite ends 46 and 48 along the adjustment space between the strap 44 and the fabric material 34, as shown by arrow Al in FIG. 1. Even though two sets of straps 44 and loops 50 are used in the object 20, any number of corresponding straps 44 and loops 50 can be provided, and even one set may be sufficient depending upon the intended application. Each loop 50 can be held in its respective adjustment space by stitching one end of strap 44 (e.g., 46) to the fabric 34 and then inserting the other end 48 through the loop 50 and stitching the other end 48 to the fabric 34.

The straps 44 can be attached anywhere on the fabric material 34 of the panel 22, but the corresponding loops 50 should be attached to locations on the fabric material 34 of the panel 24 adjacent one of the four side edges 26*a*–26*d* to allow the panels 22, 24 to be hinged and connected. For example, in FIG. 1, the straps 44 are shown as being attached adjacent the right side edge 26*c* of the panel 22 (and spaced apart between the top and bottom side edges 26*d* and 26*b*, respectively), and the loops 50 are shown as being attached adjacent the left side edge 26*a* of the panel 24 so that the panels 22, 24 are coupled adjacent these side edges 26*c* and 26*a*, respectively.

Figure 3A:
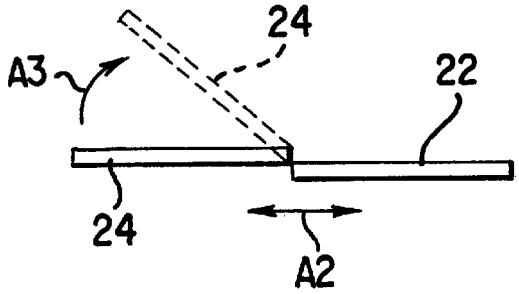
FIGS. 3A and 3B are top plan views of the object of FIG. 1 shown in use in different positions.
Figure 3B:
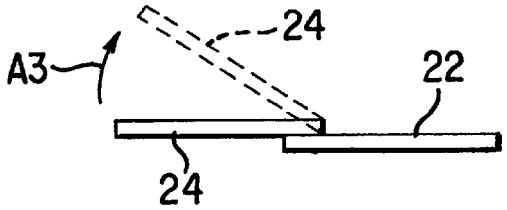

FIGS. 3A and 3B illustrate how the adjustable attachment mechanisms allow the respective positions of the panels 22, 24, and the width of the object 20, to be adjusted. In FIG. 3A, the panels 22, 24 are shown in their expanded positions and extended at the largest width of the object 20 with the right side edge 26*c* of the panel 22 and the left side edge 26*a* of the panel 24 adjacent each other and not overlapping with each other. When in this position, the loops 50 of panel 24 are adjacent the outermost end 48 of the straps 44 of panel 22. In addition, as shown in FIG. 1 and in phantom in FIG. 3A, the panel 24 may be folded or pivoted about the hinge (see arrow A3) defined by the adjustable attachment mechanisms (i.e., loops SO and straps 44) to be placed on top of the panel 22 to form a stack of two panels 22, 24.

FIG. 3A also shows that the panels 22 and 24 can be slid with respect to each other (see arrow A2) to vary the width of the object 20. This sliding can be accomplished in many ways. For example, the panels 22, 24 can be slid with respect to each other when both panels 22, 24 are generally parallel to each other (see solid lines in FIG. 3A). Or one panel 24 can be raised at an angle with respect to the other panel 22 (see FIG. 1 and phantom in FIG. 3A) and then the panels 22, 24 slid with respect to each other. Or both panels 22, 24 can be simultaneously slid with respect to each other, or one panel 24 can be slid while the other panel 22 remains stationary.

Referring now to FIG. 3B, the panels 22, 24 are now shown in their expanded positions and extended at the smallest width of the object 20. In this position, the right side edge 26*c* of the panel 22 and the left side edge 26*a* of the panel 24 are offset from each other and the fabric material 34 of the panels 22, 24 adjacent the side edges 26*c*, 26*a*, respectively, overlap each other. When in this position, the loops 50 of panel 24 are adjacent the innermost end 46 of the straps 44 of panel 22. In addition, as shown in FIG. 1 and in phantom in FIG. 3B, the panel 24 may still be folded or pivoted about the hinge (see arrow A3) defined by the adjustable attachment mechanisms (i.e., loops 50 and straps 44) to be placed on top of the panel 22 to form a stack of two panels 22, 24. In this regard, it will be appreciated that the width or length of the panels 22, 24 can be varied.

Those skilled in the art will appreciate that the width of the object 20 can be varied by varying the length of the straps 44, thereby providing a wider distance for adjusting the relative positions of the two panels 22, 24. In this regard, the object 20 is well-suited for use as a sunshield for an automobile windscreen, since the width of the object 20 can be adjusted to fit a windscreen of virtually any width. However, as illustrated hereinbelow, the object 20 is not so limited in its application and utility, and has great utility for use in other applications.

Figure 4:
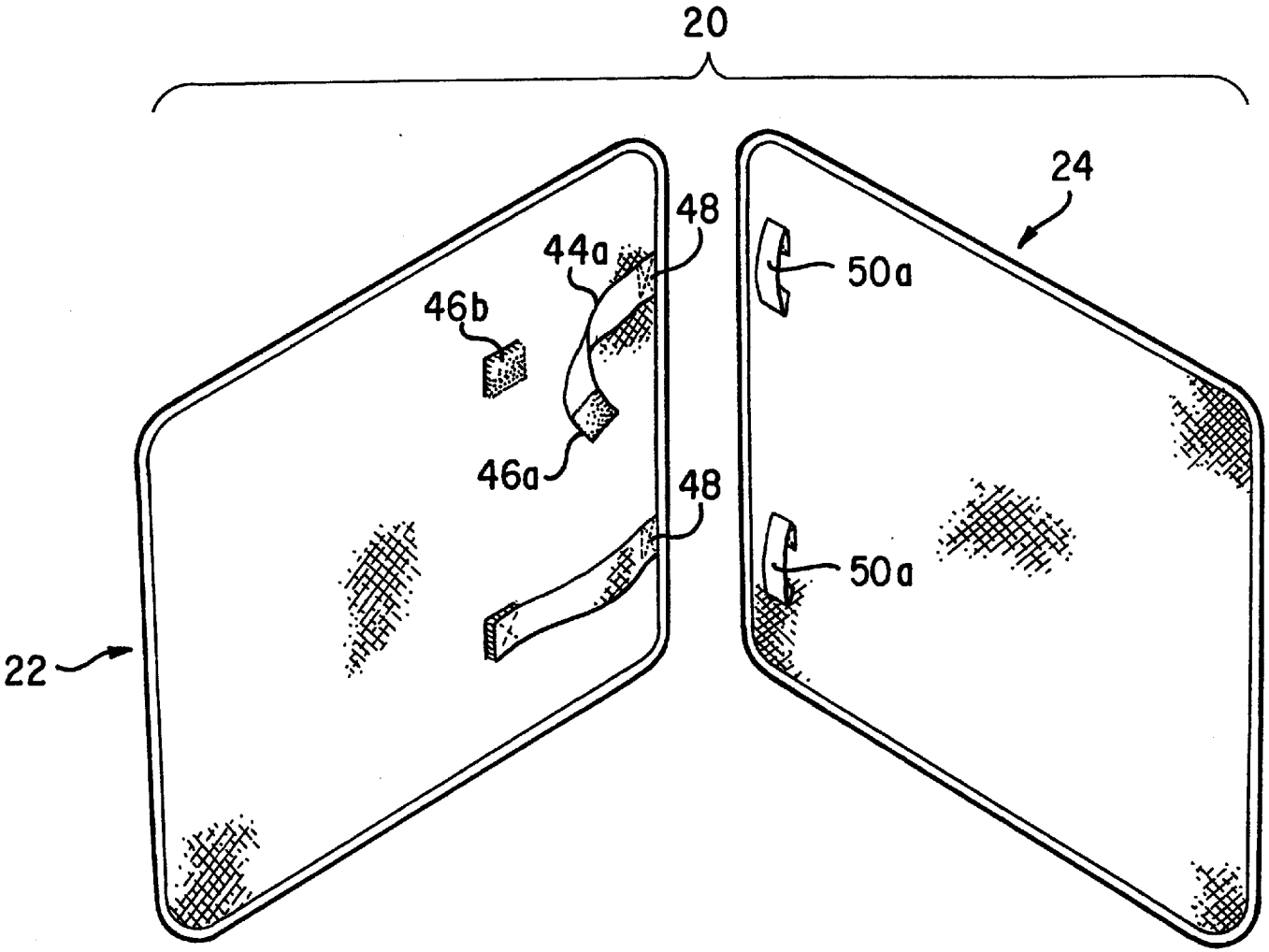
FIG. 4 is an exploded perspective view of the object of FIG. 1 illustrating a modification made thereto.

FIG. 4 illustrates a modification that can be made to the object 20 of FIG. 1. Instead of providing straps 44 that are permanently attached (e.g., by stitching) to the fabric material 34, the straps 44*a* in FIG. 4 can have one end (e.g., outermost end 48) permanently attached (e.g., by stitching) to the fabric material 34, while the other end 46*a* is free so that the two panels 22, 24 can be separated. The free end 46*a* can have a removable attachment mechanism (e.g., Velcro™, hooks, and the like) provided thereat for engaging an opposing mechanism 46*b* (e.g., the opposing Velcro™ pad, hook, or the like) provided on the fabric material 34. Each free end 46*a* can be inserted through its corresponding loop 50*a* on panel 24, and then secured to the opposing mechanism 46*b*. When secured, the straps 44*a* and their corresponding loops 50*a* operate in the same manner as illustrated in connection with FIG. 1. Loop 50*a* can be the same as loop 50 of FIG. 1, or it can even be a shorter-length strap 50*a* as shown in FIG. 4.

As a further alternative, both ends 46 and 48 of the straps 44 can be free ends having removable attachment mechanisms provided thereat.

Figure 5A:
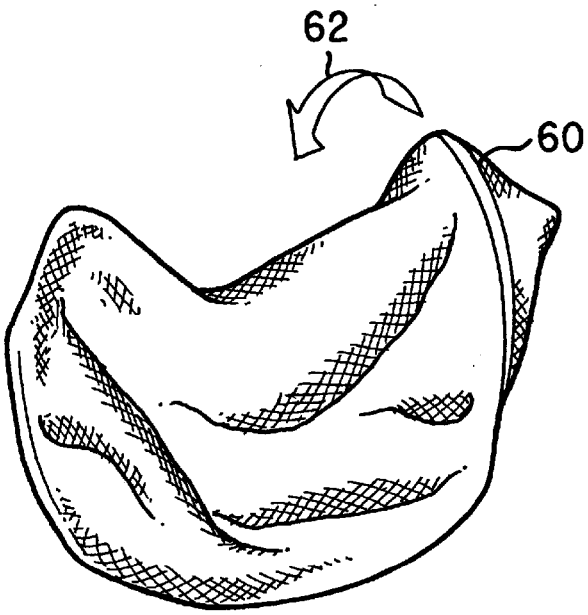
FIGS. 5A through 5D illustrate how the object of FIG. 1 may be twisted and folded for compact storage.
Figure 5B:
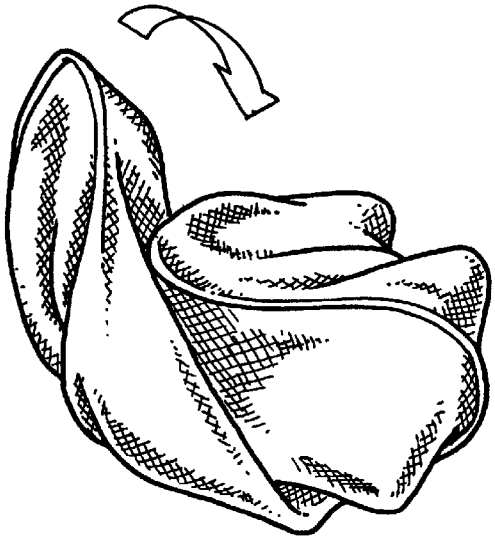
Figure 5C:
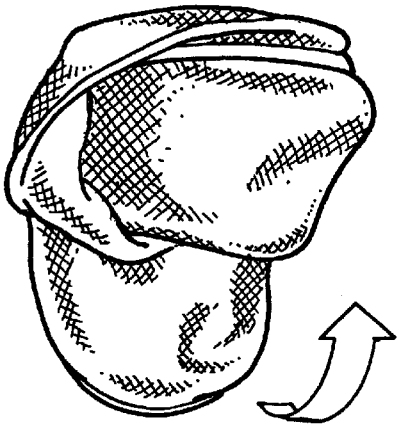
Figure 5D:
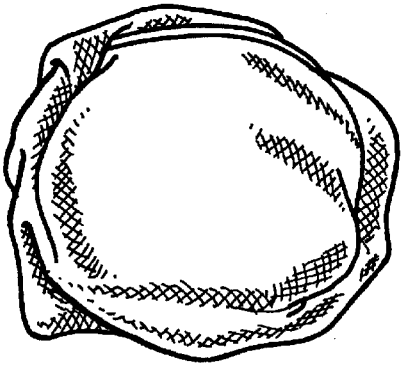

The object 20 can also be folded and collapsed into a compact configuration for storage, as illustrated in FIGS. 5A–5D. First, one panel (such as 24) is folded about the hinge defined by the adjustable attachment mechanisms (i.e., loops 50 and straps 44) to be placed on top of the other panel (such as 22) to form a stack of two panels 22, 24. Then, as shown in FIG. 5A, the opposite border 60 of the combined stack of panels 22, 24 is folded in (see arrow 62) to collapse the panels 22, 24. As shown in FIG. 5B, the collapsing is continued so that the initial size of the object 20 is reduced. FIG. 5C shows the next step, in which the panels 22, 24 are collapsed on each other to provide for a small essentially compact configuration having a plurality of concentric frame members 32 and layers of the fabric material 34 so that the collapsed object 20 has a size which is a fraction of the size of the initial object 20, as shown in FIG. 5D. Thus, the object 20 can be folded and stored very quickly using the steps illustrated in FIGS. 5A–5D.

To re-open the object 20 to its expanded configuration, the collapsed panels 22, 24 are unfolded. The memory (i.e., spring-load) of the frame members 32 will cause the frame members 32 to uncoil on their own and quickly expand the panels 22, 24 to the expanded configuration shown in FIG. 1. One panel 22 or 24 can then be pivoted with respect to the other panel 24 or 22 as shown in FIGS. 3A and 3B.

The above-described methods for folding and collapsing two adjacent panels, and for re-opening these panels to deploy the structure for use, can be applied to all the embodiments illustrated hereinbelow.

Figure 6:
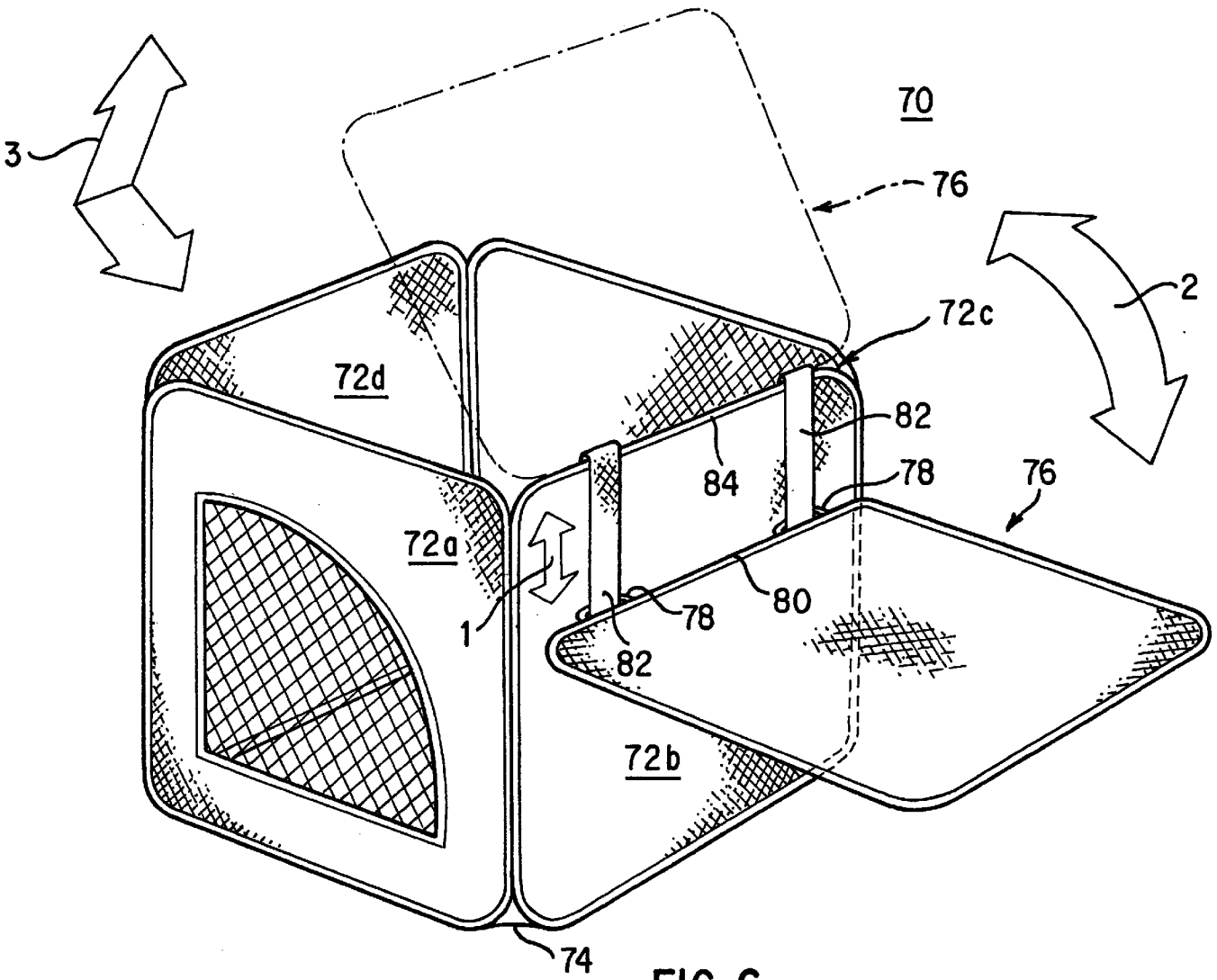
FIG. 6 is a perspective view of a collapsible structure according to another embodiment of the present invention adopting the principles of the object of FIG. 1 and shown in use in its expanded configuration.

FIG. 6 illustrates a second embodiment of the present invention, in which the principles of the present invention are utilized to provide added utility to a collapsible structure 70. The collapsible structure 70 has four panels 72*a*, 72*b*, 72*c* and 72*d* that are hingedly connected together to form an enclosed space. The structure of each panel 72*a*, 72*b*, 72*c* and 72*d* can be the same as the panels 22, 24 described above, and the panels 72*a*, 72*b*, 72*c* and 72*d* can be hingedly connected together according to the structures and techniques illustrated in connection with FIGS. 1, 1A, 2A and 2B of U.S. Pat. No. 5,560,385 (Zheng), entitled "Collapsible Play Structures", which is co-owned by the assignee of the present invention, and whose entire disclosure is incorporated by this reference as though fully set forth herein. A piece of fabric 74 may be stitched to the bottom sides of the panels 72*a*, 72*b*, 72*c* and 72*d* to form a floor or base.

In addition to the four panels 72*a*, 72*b*, 72*c* and 72*d*, the structure 70 also includes a top panel 76. Top panel 76 can have the same structure as panel 24 of FIG. 1, in which a pair of loops 78 are provided along a side edge 80 of the panel 76. A corresponding pair of straps 82 are provided on panel 72*b* adjacent a top edge 84 thereof, with these straps 82 inserted through the loops 78 to create an adjustable attachment mechanism similar to that described above. Thus, as illustrated in phantom in FIG. 6, the top panel 76 can be used as a lid to cover the top opening of the space defined by the four panels 72*a*, 72*b*, 72*c* and 72*d*. The top panel 76 can also be pivoted or folded about the top edge 84 of the panel 72*b* and then folded against the panel 72*b*, or slid downwardly along the straps 82 (as shown in FIG. 6). The structure 70 can be folded and collapsed, and re-opened, according to the principles set forth above and in U.S. Pat. No. 5,560,385 (Zheng). The structure 70 is especially well-suited for use as a play structure where a child can climb into the structure 70, or as a household container (such as a laundry hamper), or as a container for holding sporting goods (e.g., basketballs or baseballs), among other applications.

Figure 7:
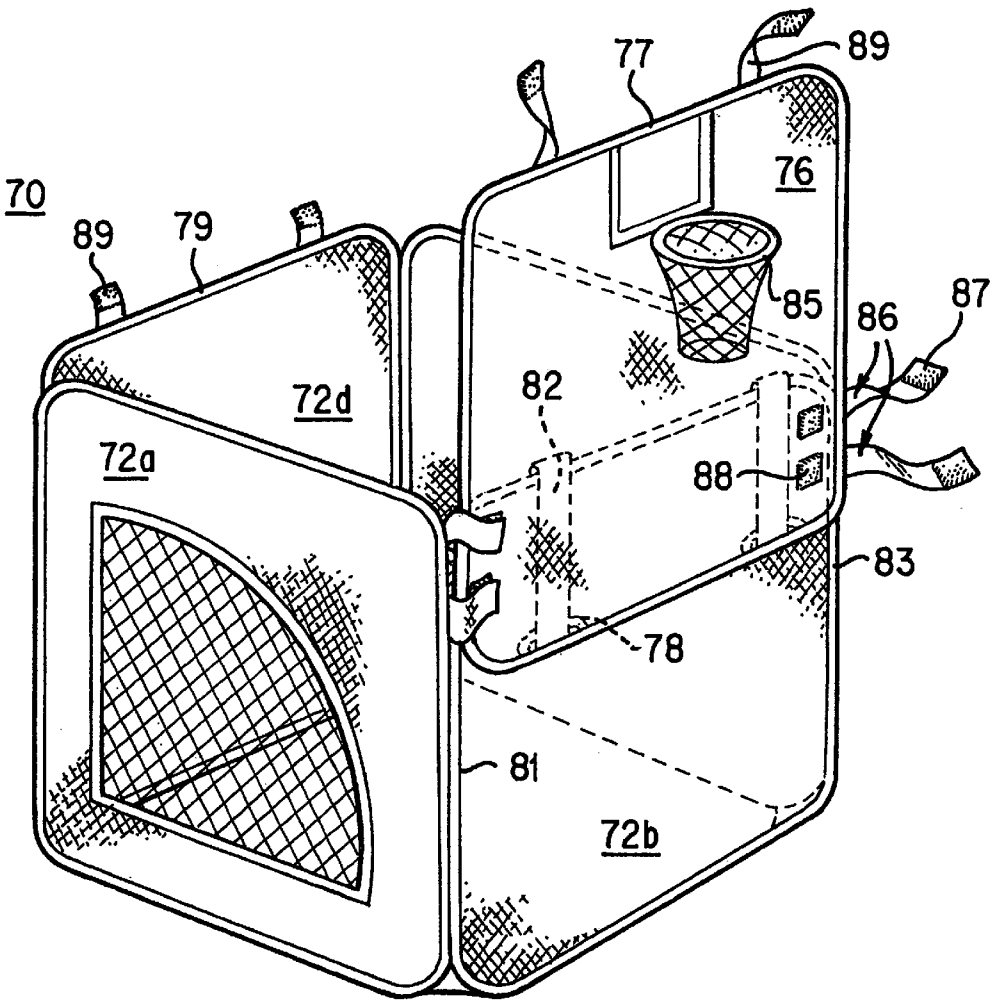
FIG. 7 is a perspective view of the object of FIG. 6 illustrating modifications made thereto.

FIG. 7 illustrates two additional features that can be provided to the structure 70. While the structure 70 was shown in FIG. 6 in use as a container or play structure, the structure 70 is shown in FIG. 7 in use as an amusement structure. In this regard, a basket 85 can be secured or otherwise attached to either the inner side or the outer side of the fabric of the top panel 76. In addition, locking mechanisms can be provided along the side edges 81 and 83 of the panel 72*b* to lock the panel 76 at a predetermined vertical position. Specifically, when the loops 78 of the panel 76 have been slid to their lowest vertical position adjacent the lower end of the straps 82, as shown in FIG. 7, the locking mechanisms can be deployed to secure the panel 76 in this vertical position. In this position, the basket 85 will be positioned at a desired height to allow the panel 76 to be used as a backboard for a ball-tossing amusement game, where balls can be tossed at the basket 85. One or more baskets 85 can be positioned on either side, or both sides, of the panel 76 to achieve the desired amusement effects.

Each locking mechanism can be a strap 86 having one end secured to a side edge 81 or 83 of panel 72*b*, and an opposing end having first connection mechanism 87 (e.g., a Velcro™ pad, hook, or other similar connection mechanism) attached thereto. An opposing Velcro™ pad, hook, or other similar connection mechanism 88 can be attached to any convenient location on the panel 76 for convenient engagement with the first connection mechanism 87. Similar locking mechanisms 89 can be provided along the top edge 77 of the top panel 76 and the top edge 79 of the panel 72*d* to secure the top panel 76 to the top edges of the panels 72*a*–72*d*. Thus, the structure 70 shown in FIG. 7 can be used both as an amusement structure and as a container.

Figure 8:
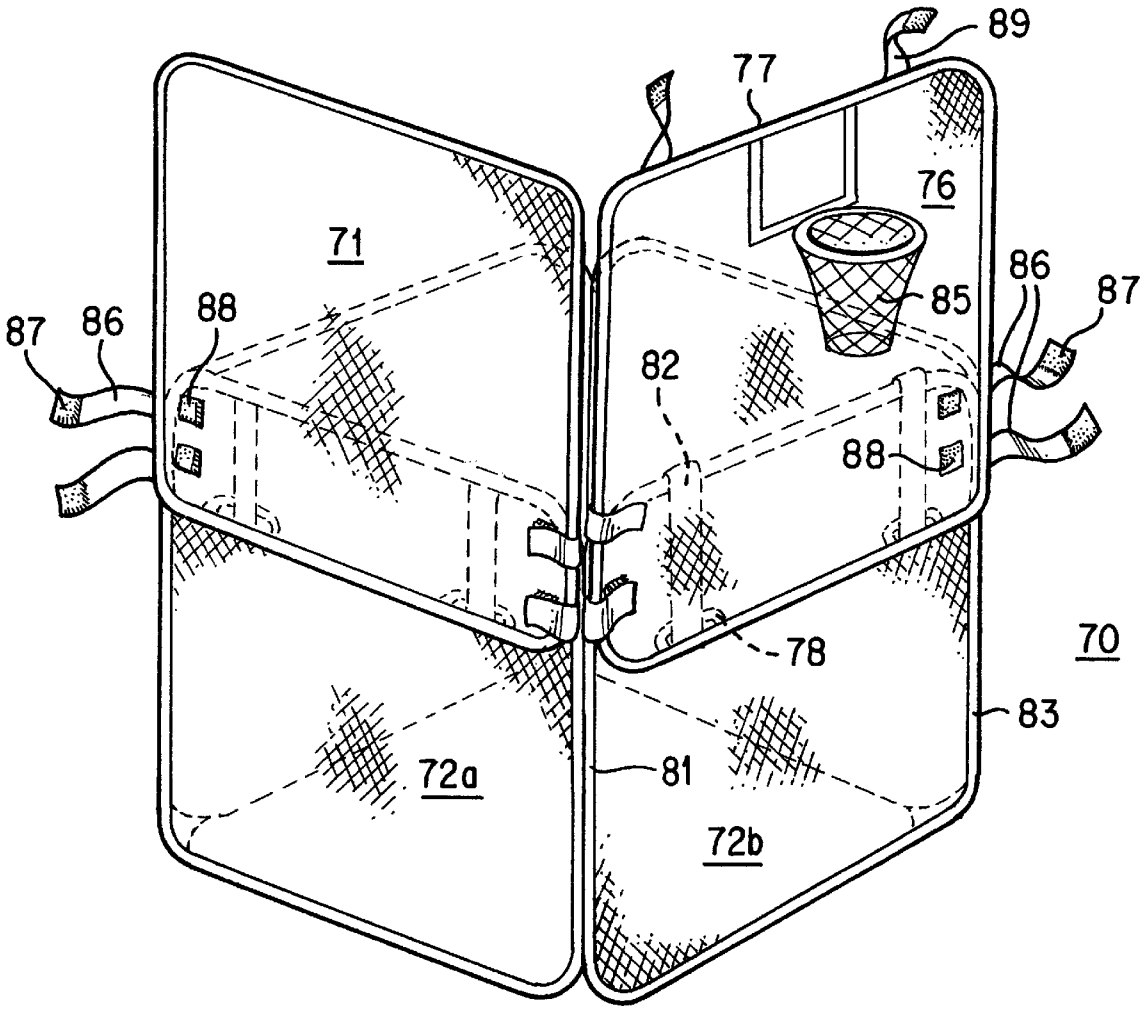
FIG. 8 is a perspective view of the object of FIG. 7 illustrating modifications made thereto.

FIG. 8 illustrates the structure 70 of FIGS. 6 and 7, but with an additional panel 71 that is coupled or attached to the panel 72*a* using the adjustable attachment mechanisms described above. In addition, locking mechanisms (such as straps 86 and connection mechanisms 87 described above) can also be provided to secure the vertical position of the panel 71. The structure 70 illustrated in FIG. 8 allows the panel 71 to be used as a top cover to the space enclosed by the panels 72*a*–72*d*, while the top panel 76 is being used as a backboard for an amusement game. Thus, the structure 70 illustrated in FIG. 8 can be simultaneously used as both a container and an amusement game.

The structure 70 in FIG. 8 can be folded and collapsed by folding the panels 71 and 76 against the panels 72*a* and 72*b*, respectively, about the hinge defined by the adjustable attachment mechanisms between these panels 71 and 72*a*, and 76 and 72*b*. The resulting structure 70 will have four sides, defined by panels 71 and 72*a* (as one side), panels 76 and 72*b* (as one side), panel 72*c* and panel 72*d*, and can be folded and collapsed, and re-opened, according to the principles set forth above and in U.S. Pat. No. 5,560,385 (Zheng).

Figure 9A:
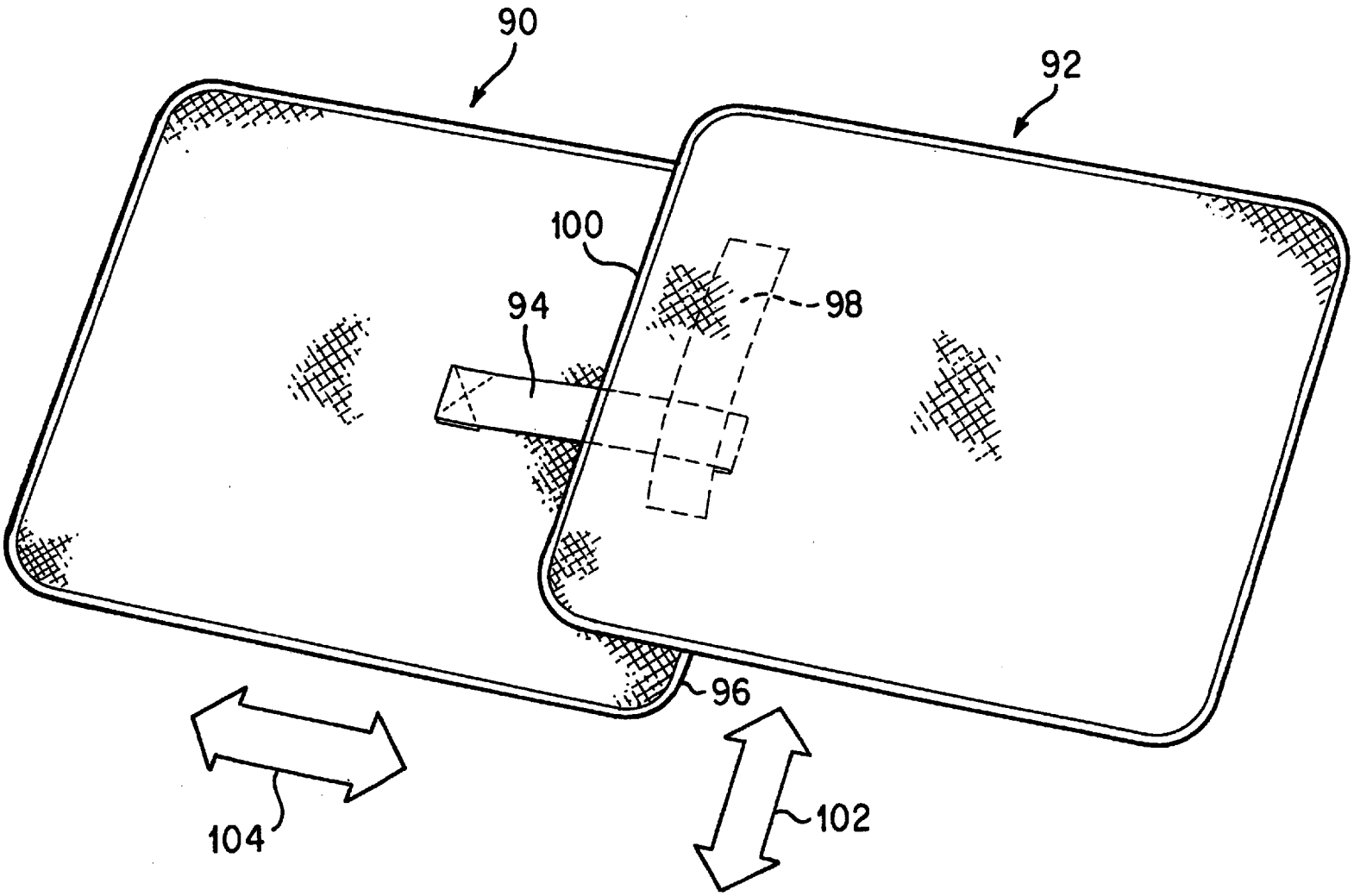
FIGS. 9A and 9B provide perspective views of a collapsible object according to a further embodiment of the present invention shown in use in its expanded configuration.

The principles of the present invention can be further modified to allow the two adjacent panels to slide vertically and horizontally with respect to each other. In FIG. 9A, two panels 90 and 92 are provided. Panel 90 can be the same as panel 22 of FIG. 1, except that only one elongated strap 94 is provided on the fabric material adjacent a right side edge 96. Panel 92 can be similar to panel 24 of FIG. 1, except that, instead of loops, an elongated strap 98 (shown in phantom), which is adapted to be positioned perpendicular to the strap 94, can be provided on the fabric material adjacent a left side edge 100. The two straps 94, 98 can be the same (and even have the same length, if desired), and are intertwined within each other so that the panels 90, 92 can be slid with respect to each other in both the vertical and horizontal directions. In other words, each strap 94, 98 is partially retained inside the adjustment space of the other strap, and each strap 94, 98 is slidable with respect to the other strap. For example, the panel 90 can be held stationary and the panel 92 slid vertically up or down (see arrow 102) with the strap 94 sliding within the space defined by the strap 98. This can also be achieved by holding panel 92 stationary and sliding panel 90 vertically up or down (see arrow 102). As yet another alternative, both panels 90, 92 can be slid simultaneously with respect to each other.

Similarly, the panel 92 can be held stationary and the panel 90 slid horizontally left or right (see arrow 104) with the strap 98 sliding within the space defined by the strap 94. This can also be achieved by holding panel 90 stationary and sliding panel 92 horizontally left or right (see arrow 104). Also, as mentioned above, both panels 90, 92 can be slid simultaneously.

Figure 9B:
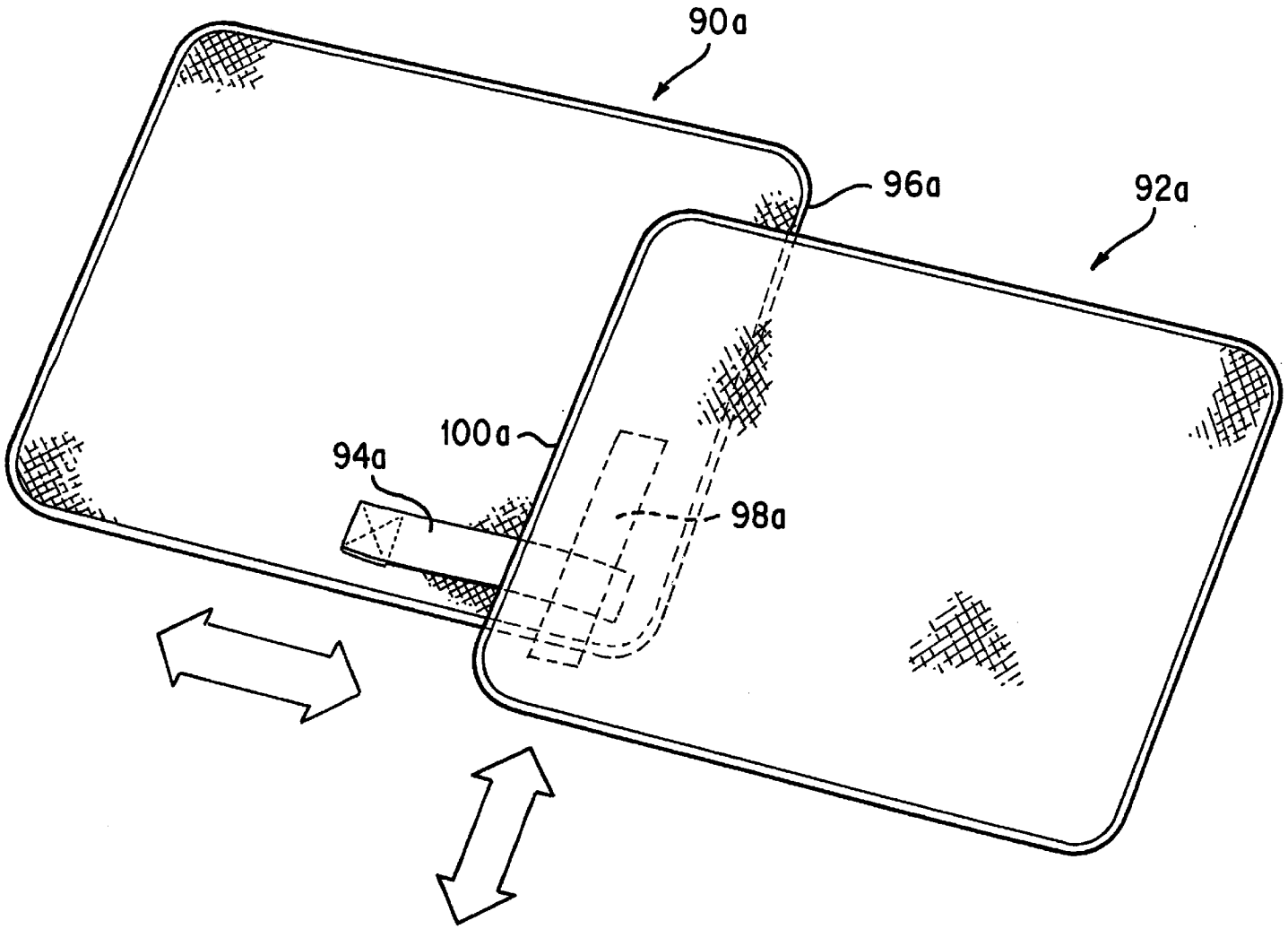

FIG. 9B illustrates a modification made to the panels 90 and 92 of FIG. 9A, in which the positions of the straps 94 and 98 on the panels 90 and 92, respectively, are changed. In FIG. 9B, the straps 94*a* and 98*a* have been lowered into corners of the panels 90*a* and 92*a*, respectively, along the same side edges 96*a* and 100*a*, respectively.

Figure 10:
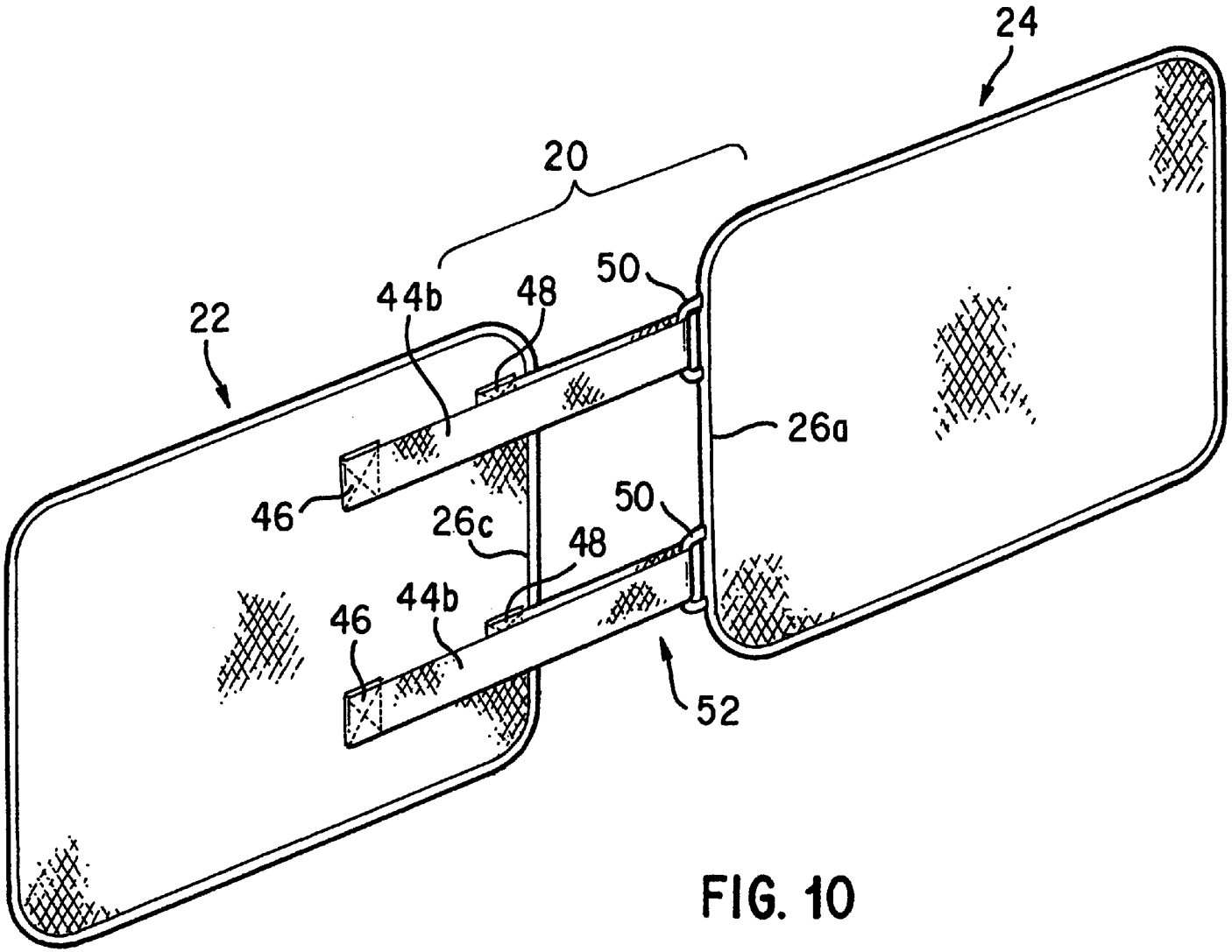
FIG. 10 is a perspective view of the object of FIG. 1 illustrating another modification made thereto.

FIG. 10 illustrates a simple modification to the object 20 of FIG. 1, in which the strap 44b is made longer, and to define a greater slack or adjustment space between its ends 46 and 48. Thus, the width of the object 20 can be even increased beyond the maximum width illustrated in FIG. 3A. In FIG. 10, a gap or space 52 will be defined between the right side edge 26*c* of panel 22 and the left side edge 26*a*, of panel 24 when the panels 22 and 24 are stretched apart to attain their maximum width.

In addition to the modifications described above, it is possible to provide all the straps 44*a* and 50*a* in FIG. 4, 82 in FIGS. 6–8, and 94 and 98 in FIGS. 9A and 9B, with at least one free end. The lengths of the straps in the various embodiments can also be varied. In addition, the object can include more than two panels, with each panel coupled to other panels by adjustable attachment mechanisms or other attachment mechanisms.

Yet other features may be provided to the object 20. For example, referring back to FIG. 1, toggles 54 can be provided on the panel 22 and adapted to fit inside receiving loops 56 on the panel 24 to maintain the relative positions of the two panels 22, 24. Two or more sets of receiving loops 56*a* and 56*b* can be provided on the panel 24. Depending on the desired overall width of the object 20 (see FIGS. 3A and 3B), the toggles 54 can be inserted into one or the other of the two sets of receiving loops 56*a* and 56*b* to secure the panels 22, 24 at their desired relative positions.

As a further example, the loops 50 and straps 44 in FIG. 1 can be omitted and replaced by elongated openings or holes provided in the fabric material 34 of panels 22, 24 adjacent the right side edge 26*c* and left side edge 26*a* of panels 22 and 24, respectively. This is illustrated in greater detail in FIGS. 11A and 11B, where, in the structure 20*x*, each strap 44 is replaced by a pair of generally parallel elongated openings or slits 43 that are created by cutting from the fabric 34*x* of the panel 22*x*, and each loop 50 is replaced by an opening 51 that is created by cutting from the fabric 34*x* of the panel 24*x*.

The panels 22*x*, 24*x* may be assembled in the following manner. First, the slits 43 are cut in the fabric 34*x* of the panel 22*x*. The region (such as 45) adjacent one end of a pair of slits 43 is cut so that the fabric between the pair of slits 43 becomes a strip 47 of fabric having a free end thereat. The free end of the strip 47 is then passed through the corresponding opening 51, and then the region 45 stitched or otherwise re-attached to the fabric 34*x* to secure the strip 47 within the opening 51, as shown in FIG. 11B. When so secured, the opening 51 and the side edge 26*a* of the panel 24*x* can slide along the slits 43 within the length defined by the two ends of the strip 47. This can be done to attach all corresponding openings 51 and pairs of slits 43.

The openings 51 can be provided adjacent the left side edge 26*a* of the panel 24*x*, and the slits 43 can be cut from adjacent the right side edge 26*c* of the panel 22*x*, extending generally parallel relative to the top and bottom side edges 26*d* and 26*b*. The width of the strip 47 is preferably smaller than the size of the opening 51. Thus, the structure 20*x* operates in a similar manner as the structure 20, with the opening 51 sliding along the path or track created by the corresponding pair of slits 43 to adjust the position of the panels 22*x*, 24*x* relative to each other. In this regard, the slits 43, and in particular the length of the slits 43 (the length of the slits 43 being defined by their opposing ends), define an adjustment space for sliding the opening 51 and side edge 26*a* of the panel 24*x*. The side edge 26*a* of the panel 24*x* can be made up of the frame retaining sleeve 30 and frame member 32 of the panel 24*x*.

Figure 11A:
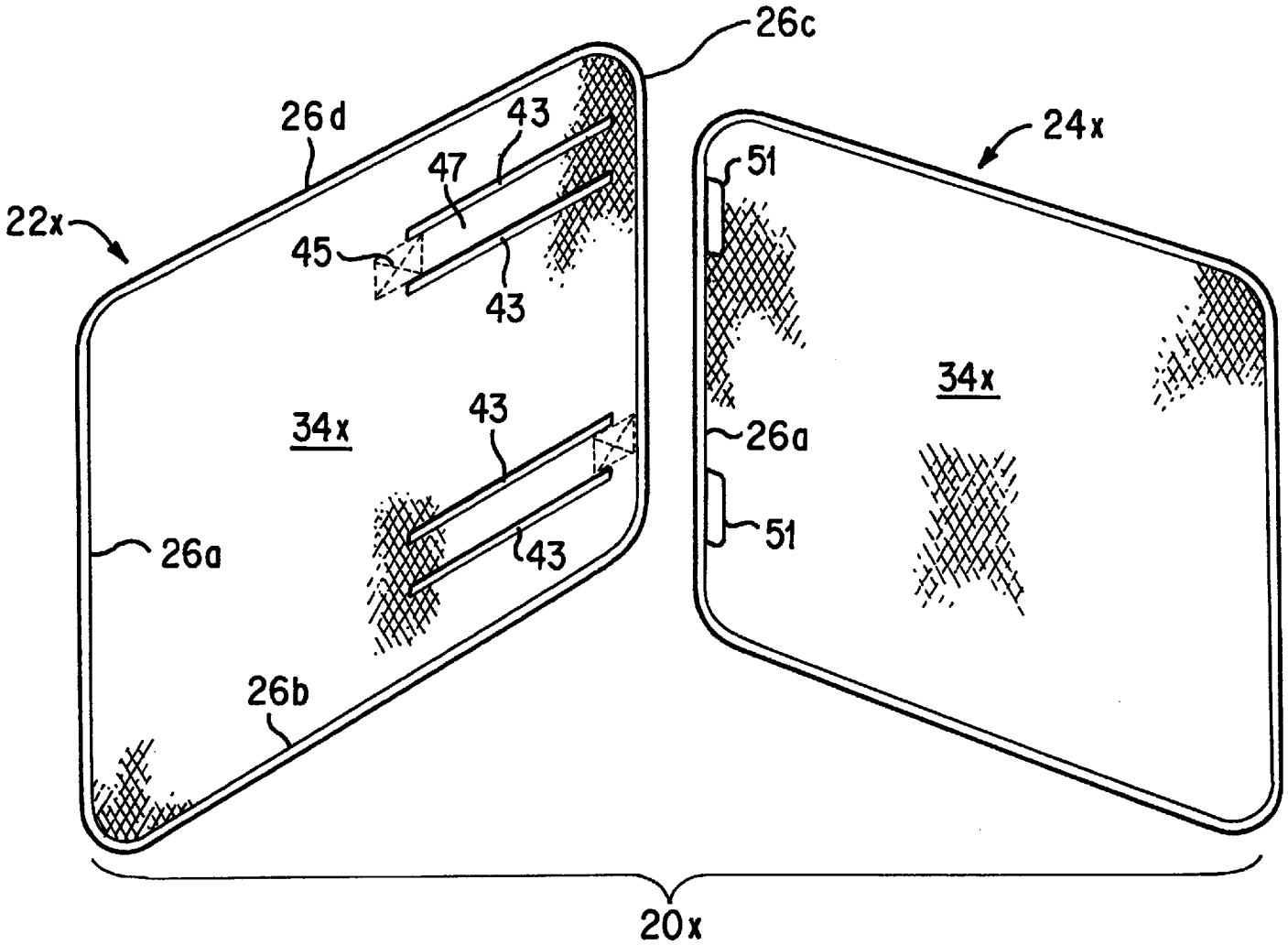
FIG. 11A is an exploded perspective view of a collapsible object according to yet a further embodiment of the present invention shown in use in its expanded configuration.
Figure 11B:
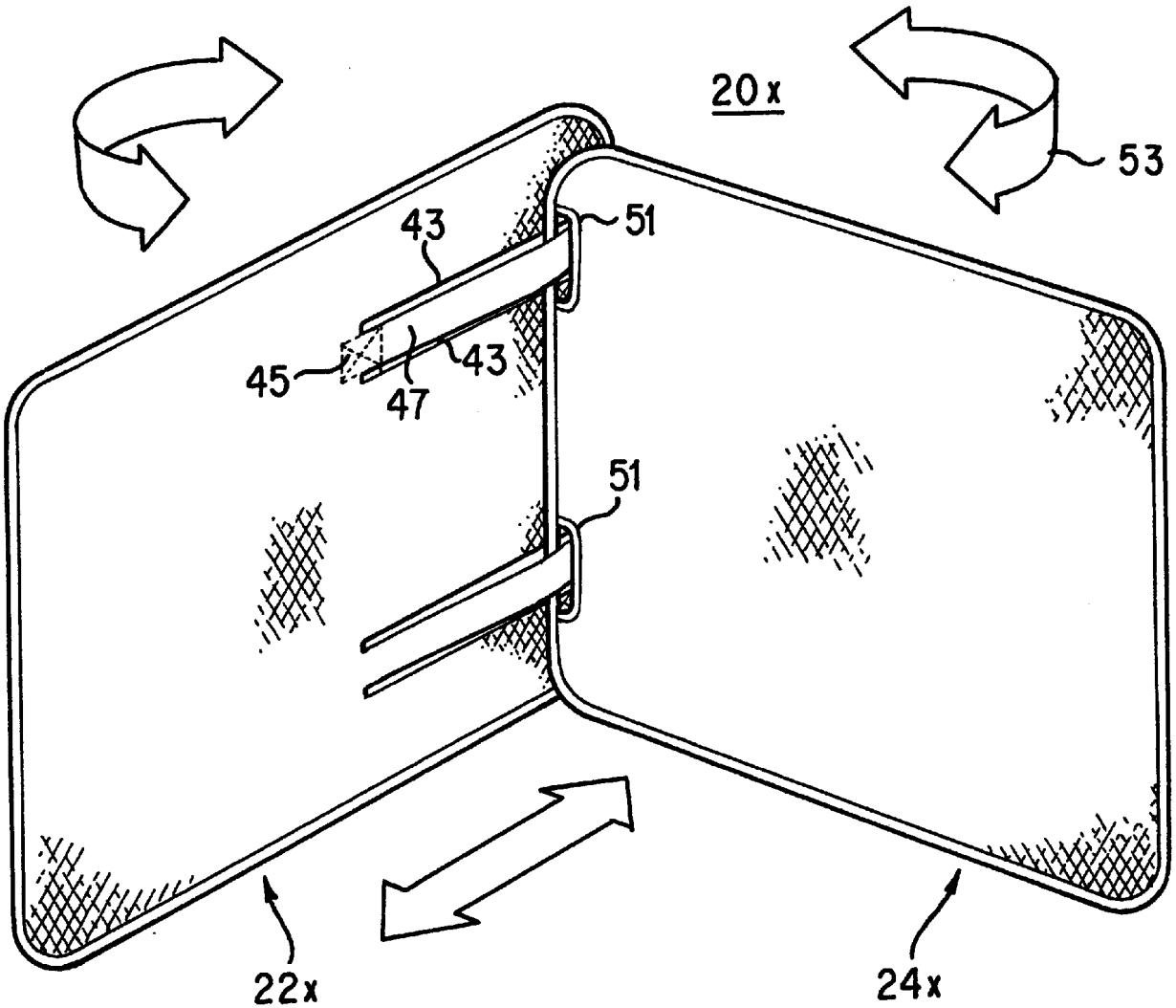
FIG. 11B is a perspective view of the object of FIG. 11A shown assembled together.
Figure 12A:
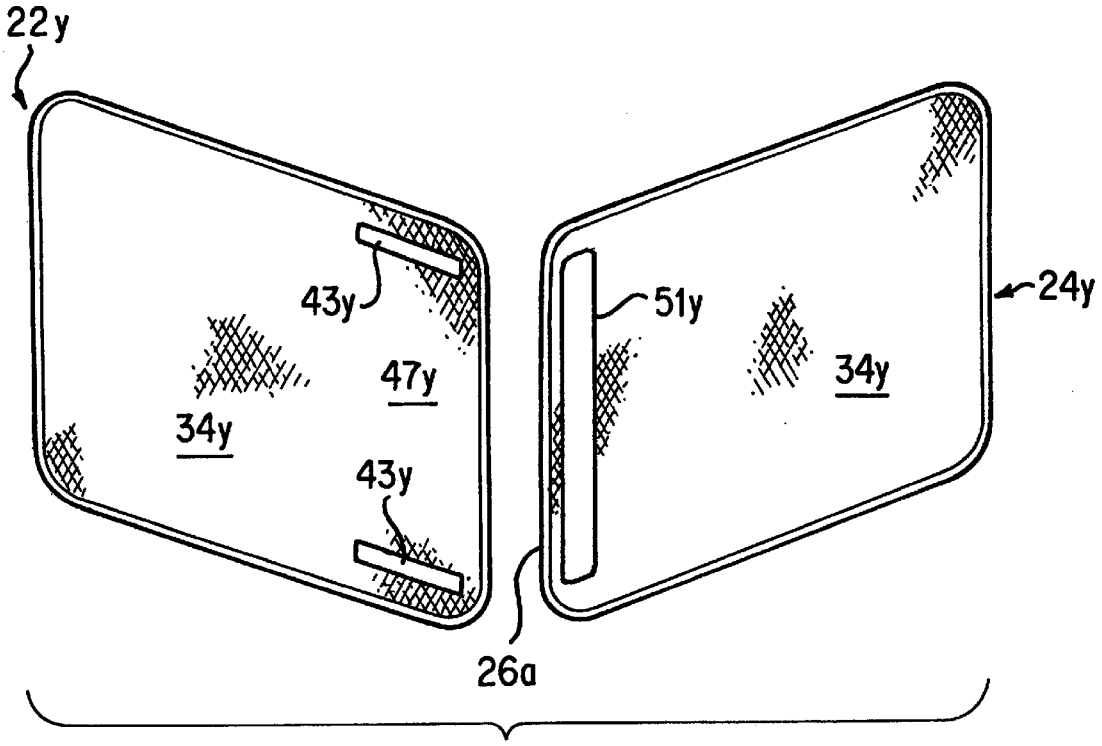
FIG. 12A is an exploded perspective view of the object of FIGS. 11A and 11B illustrating modifications made thereto.
Figure 12B:
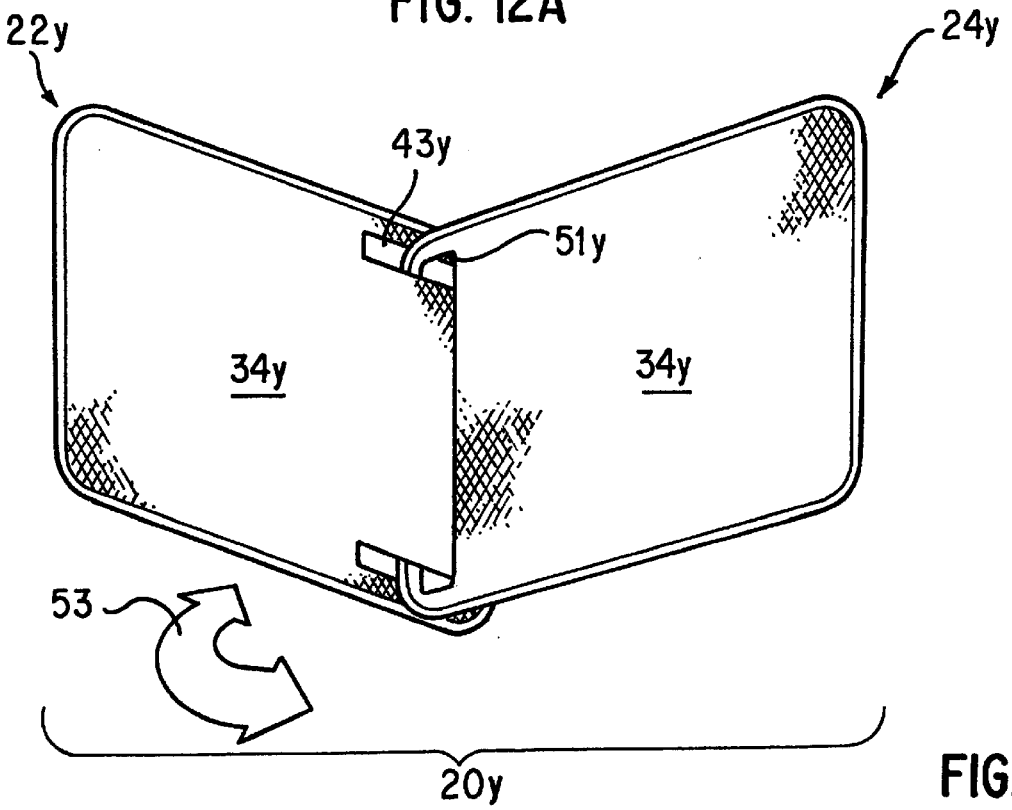
FIG. 12B is a perspective view of the object of FIG. 12A shown assembled together.

FIGS. 12A and 12B illustrate a structure 20*y* that reflects a simple modification of the structure 20*x* in FIGS. 11A and 11B. The two pairs of slits 43 and openings 51 in structure 20*x* are replaced in structure 20*y* by one pair of slits 43*y* and one elongated opening 51*y*. Specifically, the panel 22*y* has one pair of slits 43*y* that are spaced further apart from each other than the slits 43 in panel 22*x*, and the panel 24*y* has one elongated opening 51*y* that extends along a length or portion of the side edge 26*a*. The panels 22*y*, 24*y* may be assembled in the same manner as panels 22*x*, 24*x* of structure 20*x*. First, the slits 43*y* are cut in the fabric 34*y* of the panel 22*y* so that the fabric between the pair of slits 43*y* becomes a strip 47*y* of fabric having a free end thereat. The free end of the strip 47*y* is then passed through the opening 51*y*, and then the free end stitched or otherwise re-attached to the fabric 34*y* to secure the strip 47*y* within the opening 51*y*, as shown in FIG. 12B. When so secured, the opening 51*y* and the side edge 26*a* of the panel 24*y* can slide along the slits 43*y* within the length defined by the two ends of the strip 47*y*. The structure 20*y* operates in the same manner as the structure 20*x*, with the opening 51*y* sliding along the path or track created by the corresponding pair of slits 43*y* to adjust the position of the panels 22*y*, 24*y* relative to each other. In this regard, the length of the slits 43*y* (the length of the slits 43*y* being defined by their opposing ends) define an adjustment space for sliding the opening 51*y* and side edge 26*a* of the panel 24*y*.

Figure 13:
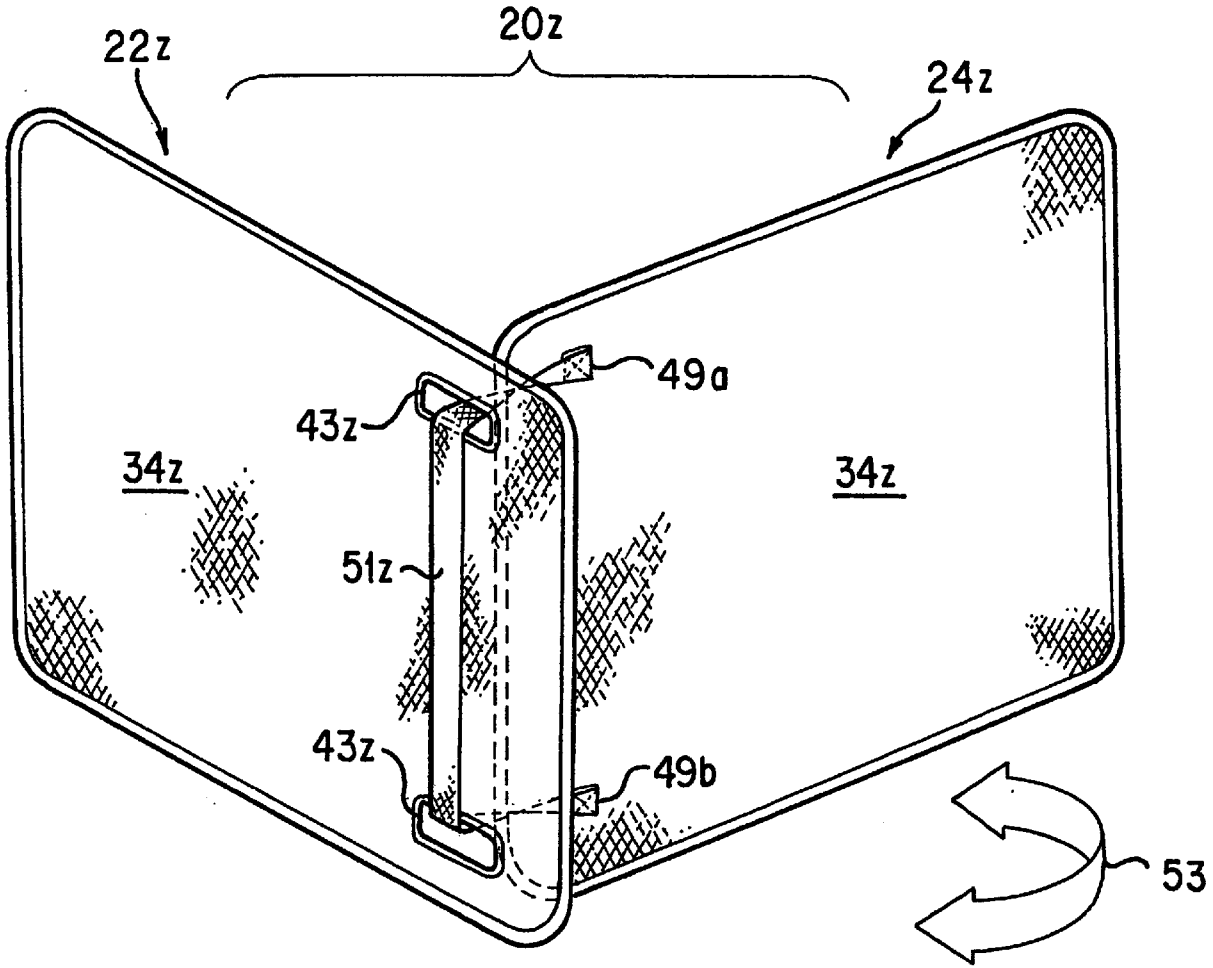
FIG. 13 is a perspective view of a collapsible object according to yet a further embodiment of the present invention shown in use in its expanded configuration.

FIG. 13 illustrates another structure 20*z* that reflects further modifications of the structure 20*y* in FIGS. 12A and 12B. Like structure 20*y*, the structure 20*z* has a pair of parallel horizontal slits or elongated openings 43*z* in panel 22*z*. However, instead of the elongated opening 51*y*, the panel 24*z* is provided with a strap 51*z*. The strap 51*z* has a first end 49*a* that is attached to any location of the fabric 34*z* of panel 24*z*, and a second end 49*b* that can be passed through both openings 43*z* and attached to another location of the fabric 34*z* of panel 24*z* spaced-apart from the location of the first end 49*a*. Thus, the structure 20*z* operates in the same manner as the structure 20*y*, with the strap 51*z* sliding along the path or track created by the corresponding pair of openings 43*z* to adjust the position of the panels 22*z*, 24*z* relative to each other. In this regard, the length of the pair of openings 43*z* define an adjustment space for sliding the strap 51*z* of the panel 24*z*.

As indicated by the arrow 53 in FIGS. 12B and 13, one panel (22 or 24) may be folded onto the other panel about the hinged connection formed by the openings 43*y* or 43*z* and corresponding opening 51*y* or strap 51*z*.

Figure 14B:
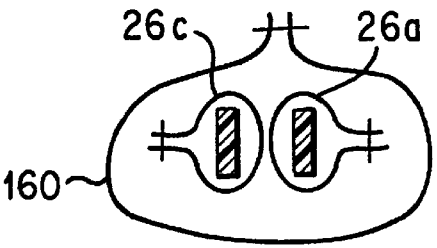
FIG. 14B is a cross-sectional view of the section 14—14 of the object of FIG. 14A illustrating portions of two panels retained within a sleeve.
Figure 14A:
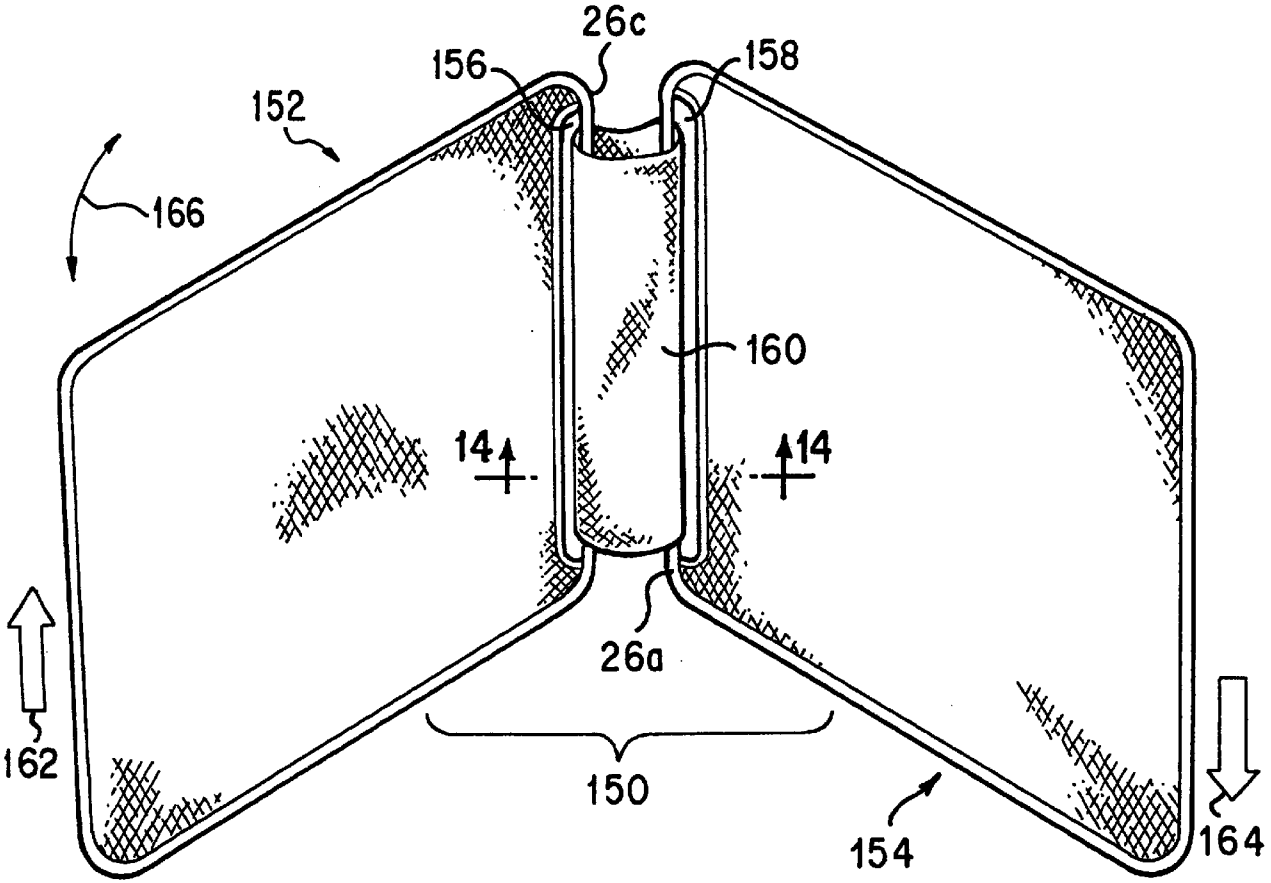
FIG. 14A is a perspective view of a collapsible object according to yet a further embodiment of the present invention shown in use in its expanded configuration.

The adjustable attachment mechanisms can also be embodied in a wide variety of other ways, as illustrated in the following embodiments. For example, the structure 150 in FIG. 14A uses a sleeve as an adjustable attachment mechanism. Referring to FIG. 14A, two panels 152 and 154 are provided. Panel 152 can be essentially the same as panel 22 of FIG. 1, except that the straps 44 are not provided, but instead, a vertical elongated opening 156 is provided that extends along a length or portion of the right side edge 26*c*. Similarly, panel 154 can be essentially the same as panel 24 of FIG. 1, except that the loops 50 are not provided, but instead, a vertical elongated opening 158 is provided that extends along a length or portion of the left side edge 26*a*. A retaining sleeve 160 extends through the openings 156 and 158 to couple the panels 152, 154 together (see also FIG. 14B). The sleeve 160 can be provided in the form of a piece of fabric material having two ends, with one end of the fabric inserted through the openings 156, 158 and then stitched to the other end to form an enclosed sleeve. The sleeve 160 can have a length that is less than the length of the openings 156, 158 so that the two panels 152, 154 can be slid in opposing directions (see arrows 162, 164) to adjust the relative vertical positions of the two panels 152, 154.

Figure 15B:
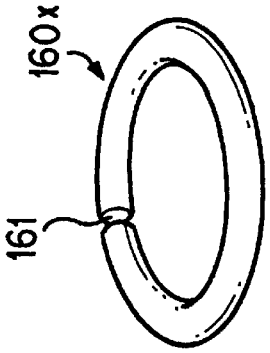
FIGS. 15B and 15C are perspective views of key rings that can be used with the object of FIG. 15A.
Figure 15C:
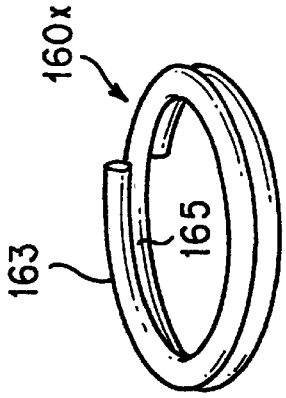
Figure 15A:
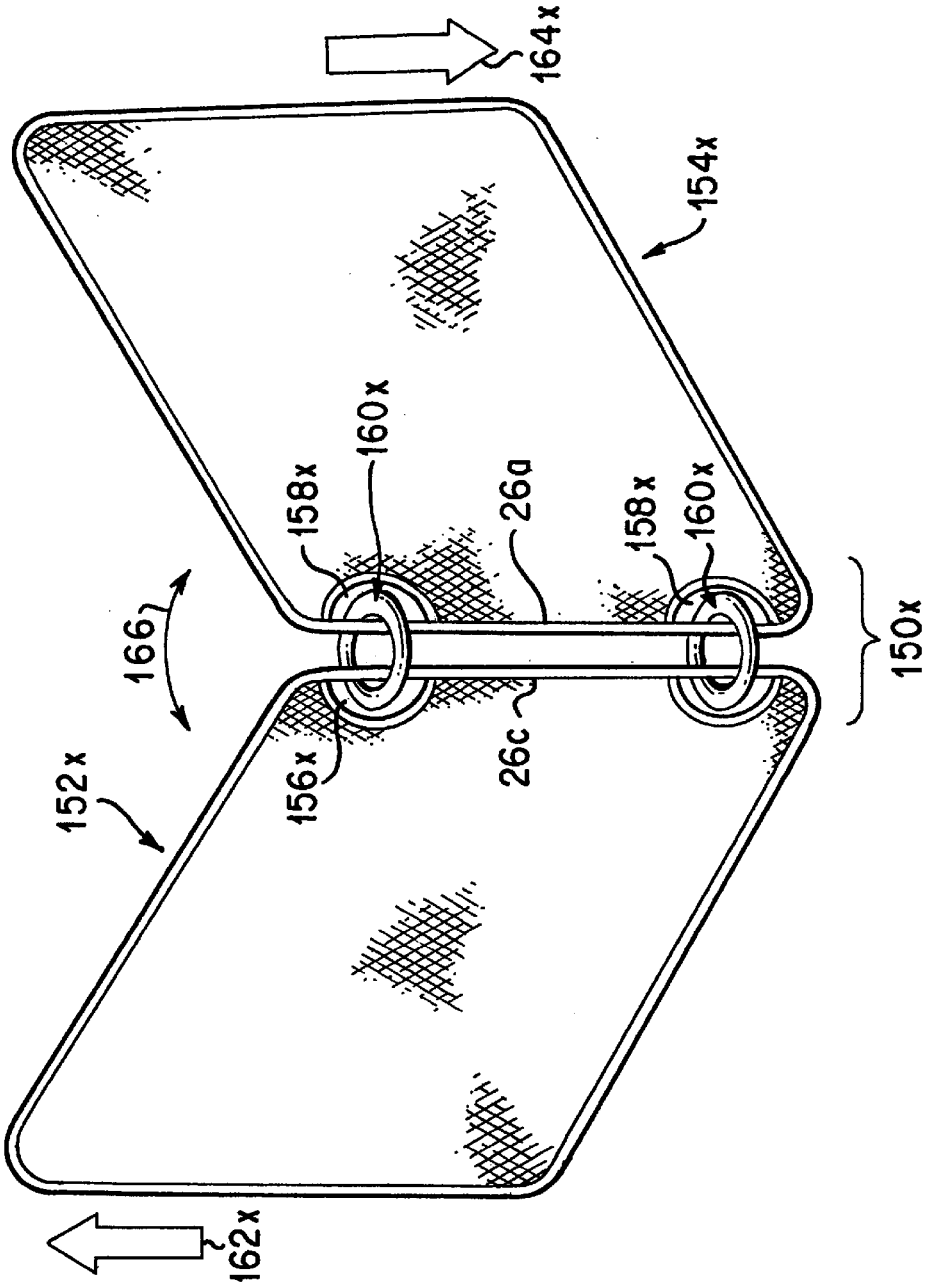
FIG. 15A is a perspective view of a collapsible object according to yet a further embodiment of the present invention shown in use in its expanded configuration.

As another example, the structure 150*x* in FIG. 15A uses one or more rings as adjustable attachment mechanisms. Referring to FIG. 15A, two panels 152*x* and 154*x* are provided. Panel 152*x* can be essentially the same as panel 152 of FIG. 14A, except that two openings 156*x* are provided (instead of the elongated opening 156) in a spaced apart manner along a length or portion of the right side edge 26*c*. Similarly, panel 154*x* can be essentially the same as panel 154 of FIG. 14A, except that two openings 158*x* are provided (instead of the elongated opening 158) in a spaced apart manner along a length of the left side edge 26*a*. A ring 160*x* can be provided to extend through each corresponding pair of openings 156*x* and 158*x* to couple the panels 152*x*, 154*x* together. As non-limiting examples (see FIGS. 15B and 15C), the rings 160*x* can be provided in the form of a resilient key ring having (1) a small opening 161 (in FIG. 15B) between both ends of the key ring to allow the side edges 26*a* and 26*c* of the panels 152*x*, 154*x* to be slid therethrough, or (2) overlapping resilient portions 163 and 165 similar to the key rings found on conventional key chains. The openings 156*x*, 158*x* are substantially larger than the thickness of the rings 160*x* so that the two panels 152*x*, 154*x* can be slid in opposing directions (see arrows 162*x*, 164*x*) to adjust the relative vertical positions of the two panels 152*x*, 154*x*.

As indicated by the arrows 166 in FIGS. 14A and 15A, one panel (150 or 152) may be folded onto the other panel about the hinged connection formed by the sleeve 160 or rings 160*x*, and the corresponding openings 156, 158.

Figure 16A:
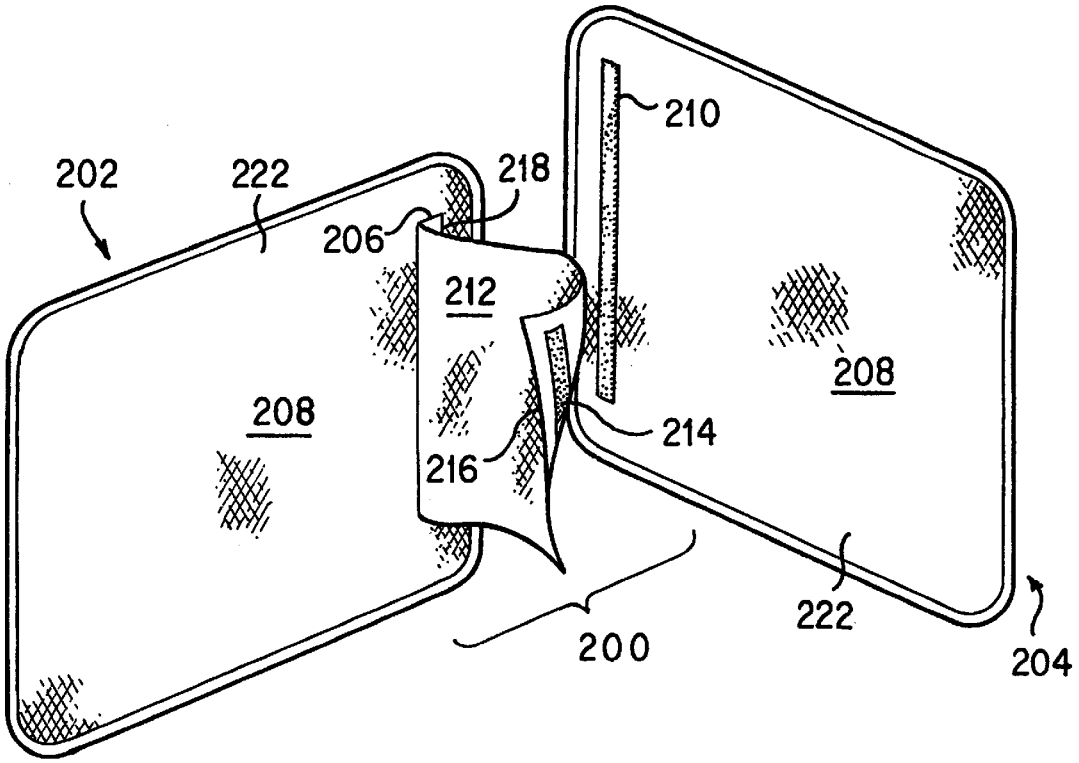
FIG. 16A is an exploded perspective view of a collapsible object according to yet a further embodiment of the present invention shown in use in its expanded configuration.
Figure 16B:
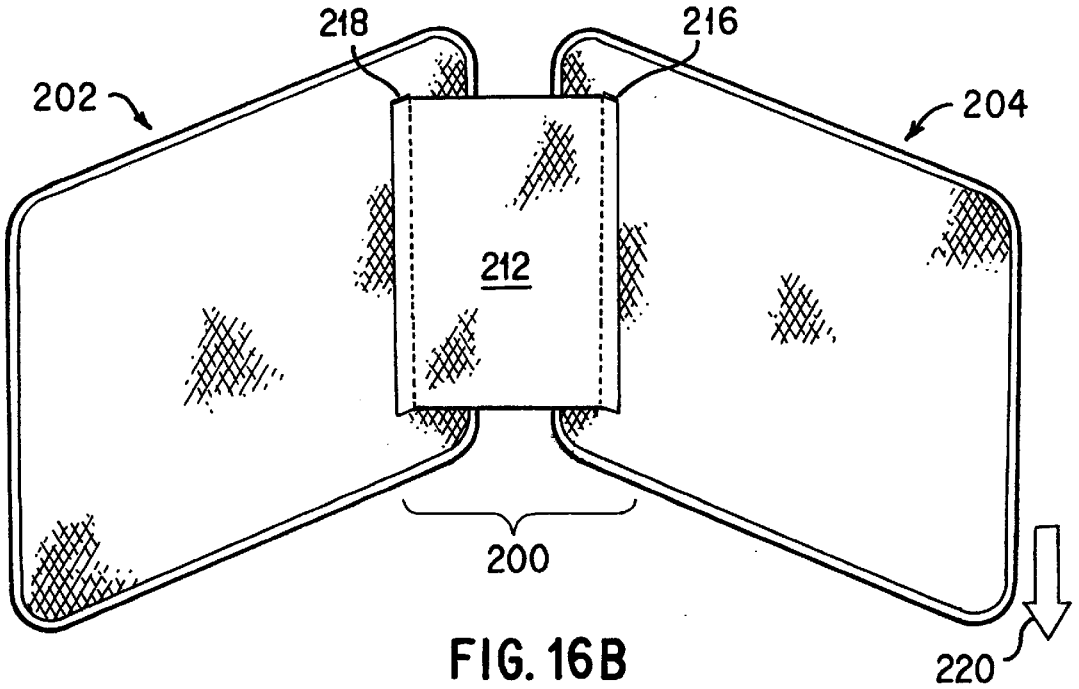
FIG. 16B is a perspective view of the object of FIG. 16A shown assembled together.

As yet another example, the structure 200 in FIGS. 16A and 16B uses a removable or detachable piece of material (also known as a "connector") as the adjustable attachment mechanism. Two panels 202 and 204 are provided. Panel 202 can be essentially the same as panel 22 of FIG. 1, except that the panel 202 can have one or more detachable attachment devices 206 provided on its fabric 208 instead of a plurality of straps 44. Similarly, panel 204 can be essentially the same as panel 24 of FIG. 1, except that the panel 204 can have one or more corresponding detachable attachment devices 210 provided on its fabric 208 instead of a plurality of loops 50. The detachable attachment devices 206, 210 can be provided anywhere on panels 202 and 204 in a permanent (e.g., by stitching, gluing, etc.) or non-permanent (e.g., using a sticky pad) manner, and can be any conventional detachable attachment device, such as snaps, hooks or VELCRO™ tabs, among others. For example, if the fabric 208 has a rough texture, such as wool, linen or is a meshed material, then a VELCRO™ tab can be easily adhered thereto. A removable or detachable piece of material 212 or connector is used to hingedly couple the panels 202, 204 together. The connector 212 can be a piece of fabric or one or more straps. In this regard, detachable attachment devices 214 can be provided along one or both opposing edges 216, 218 of the connector 212, and are adapted to engage the corresponding detachable attachment mechanisms 206, 210 on panels 202 and 204. If the detachable attachment device 214 is provided only along one edge, such as 216, then the other edge 218 can be permanently attached (e.g., by stitching) to the fabric 208 of the panel 202, so that the detachable attachment device 206 can be omitted. FIG. 16A illustrates the connector 212 having one edge 216 detached from the panel 204, while FIG. 16B illustrates the same connector 212 connecting both panels 202, 204 together.

Thus, the connector 212 can be detached and removed from one or both panels 202, 204. More importantly, the configuration of the structure 200 can be adjusted by causing the detachable attachment device(s) 214 to engage the corresponding detachable attachment devices 206, 210 at different positions. For example, if it is desired to position the panel 204 at a lower vertical direction (see direction of arrow 220) than panel 202, the panel 204 can be positioned at the desired lower vertical position, and then the detachable attachment device 214 along edge 216 of the connector 212 is engaged with detachable attachment device 210 to secure the panels 202 and 204 at the desired relative positions. Only a part of the length of the detachable attachment device 214 along edge 216 of the connector 212 will engage a part of the length of the detachable attachment device 210 because of the vertically offset nature of panel 204 with respect to connector 212. It is also possible to cause only a part of the length of the detachable attachment device 214 along edge 218 of the connector 212 to engage a part of the length of the detachable attachment device 206 on panel 202, so that the connector 212 will be offset from both panels 202, 204.

Therefore, by positioning the detachable attachment devices 206, 210 at different locations on panels 202, 204, the configuration of the structure 200 can be varied. This is further illustrated in FIGS. 16D and 18 below. In addition, the configuration of the structure 200 can be further varied by adjusting the engagement of the detachable attachment devices 206, 210, 214 as described above. The width of the connector 212 can be varied depending on the amount or degree of adjustment desired.

Figure 16C:
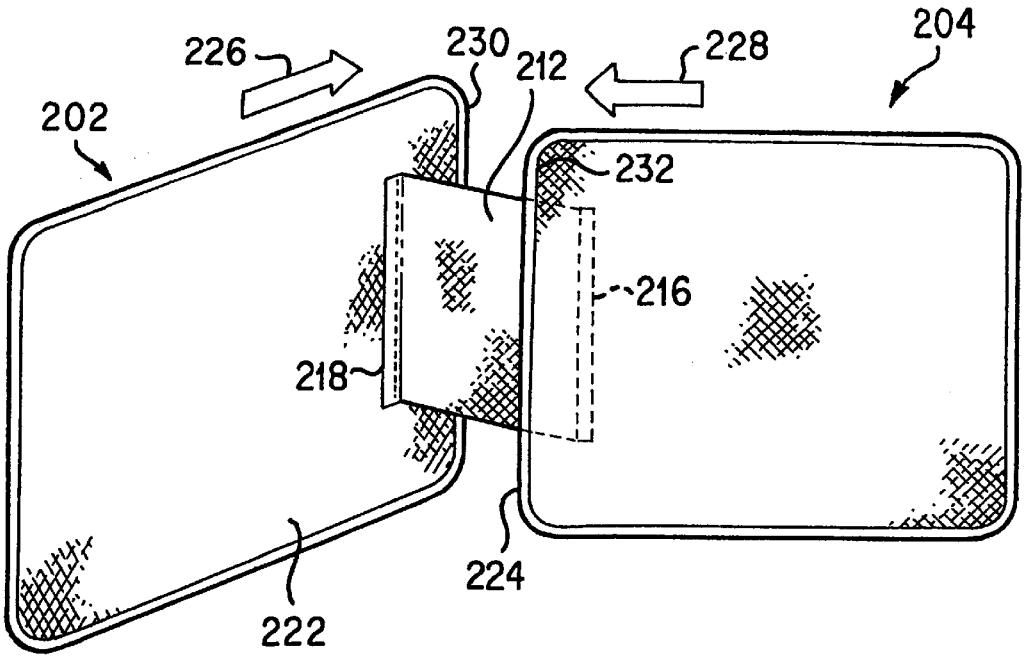
FIGS. 16C and 16D are perspective views of the object of FIGS. 16A and 16B illustrating modifications made thereto.

As shown in FIG. 16B, the connector 212 is attached to the same surface 222 (e.g., a first or interior or exterior surface) of both panels 202, 204. However, as shown in FIG. 16C, the opposing edges 218 and 216 of connector 212 can be attached to a first surface 222 of panel 202 and a second surface 224 of panel 204, respectively. This allows the width of structure 200 to be adjusted differently. For example, the panels 202, 204 in FIG. 16C can be positioned towards each other in the directions indicated by arrows 226, 228 so that a portion of the right side 230 of panel 202 overlaps a portion of the left side 232 of panel 204, with the connector 212 collapsed flat and sandwiched between the overlapping portions of the panels 202, 204. On the other hand, such an overlapping configuration is less convenient and desirable in FIGS. 16A and 16B since the connector 212 cannot be sandwiched or retained between the overlapping portions of the panels 202, 204, but would instead be "floating" above the first surface 222 of panels 202, 204. In this regard, the configuration shown in FIGS. 16A and 16B, with the connector 212 attached to the same side of both panels 202, 204, is better suited for certain applications (e.g., extending the width of structure 200, or for forming angled walls, as illustrated below), while the configuration shown in FIG. 16C, with the connector 212 attached to the different sides 222, 224 of both panels 202, 204, is better suited for other applications (e.g., shortening the width of structure 200).

Thus, the width of the structure 200 is greatest when the connector 212 is stretched to its greatest width, and the width of the structure 200 is smallest when the panels 202, 204 overlap each other with the connector 212 retained between the overlapping panels 202, 204.

Figure 16D:
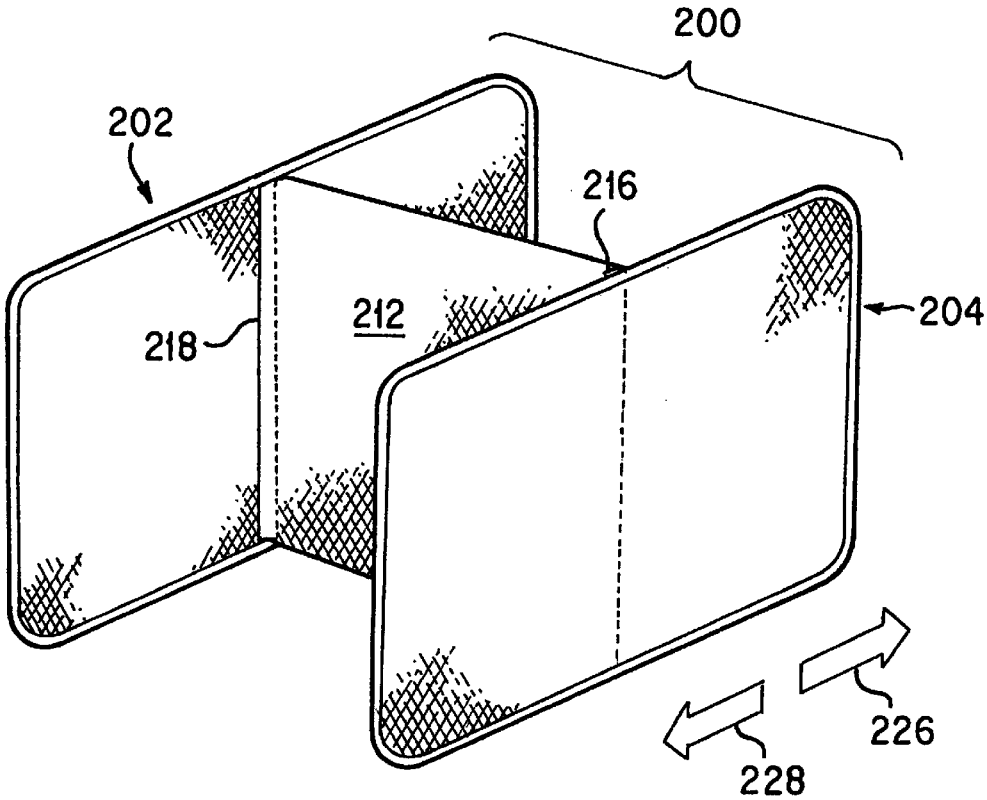

FIG. 16D illustrates the opposing edges 216 and 218 of the connector 212 positioned at about the center of both panels 202, 204. When so configured, the structure 200 can be used as a partition, with connector 212 acting as a wall or divider. In addition, one of the panels 204 can be adjusted in either of the directions indicated by arrows 226, 228 to change the angle of the connector 212, and the position of the panels 202, 204 with respect to each other. In this embodiment, the connector 212 may be provided with a greater width if a wider divider or wall is desired.

Figure 17B:
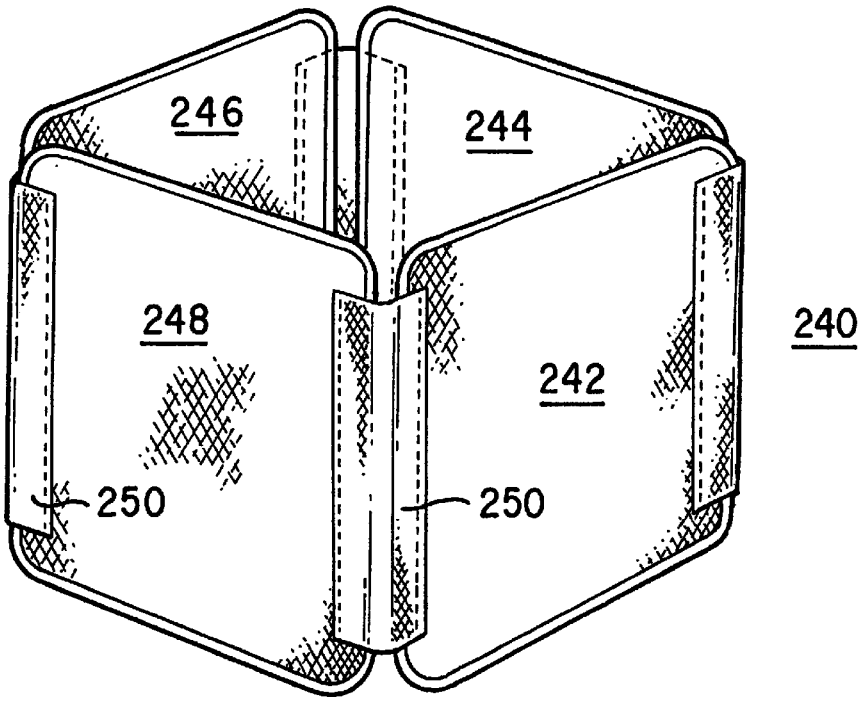
FIGS. 17B and 17C are perspective views of the object of FIG. 17A illustrating modifications made thereto.
Figure 17A:
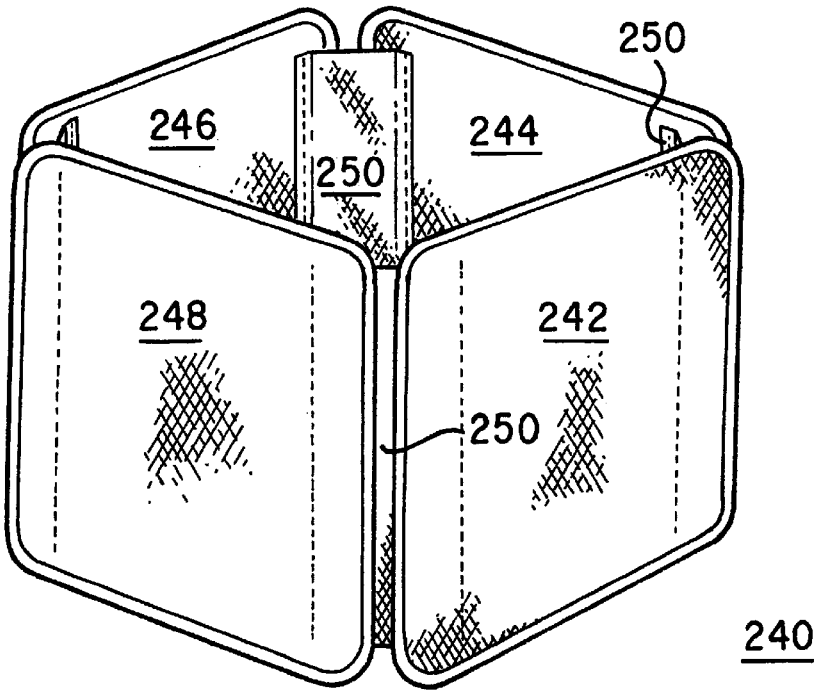
FIG. 17A is a perspective view of a collapsible object according to yet a further embodiment of the present invention shown in use in its expanded configuration.
Figure 17C:
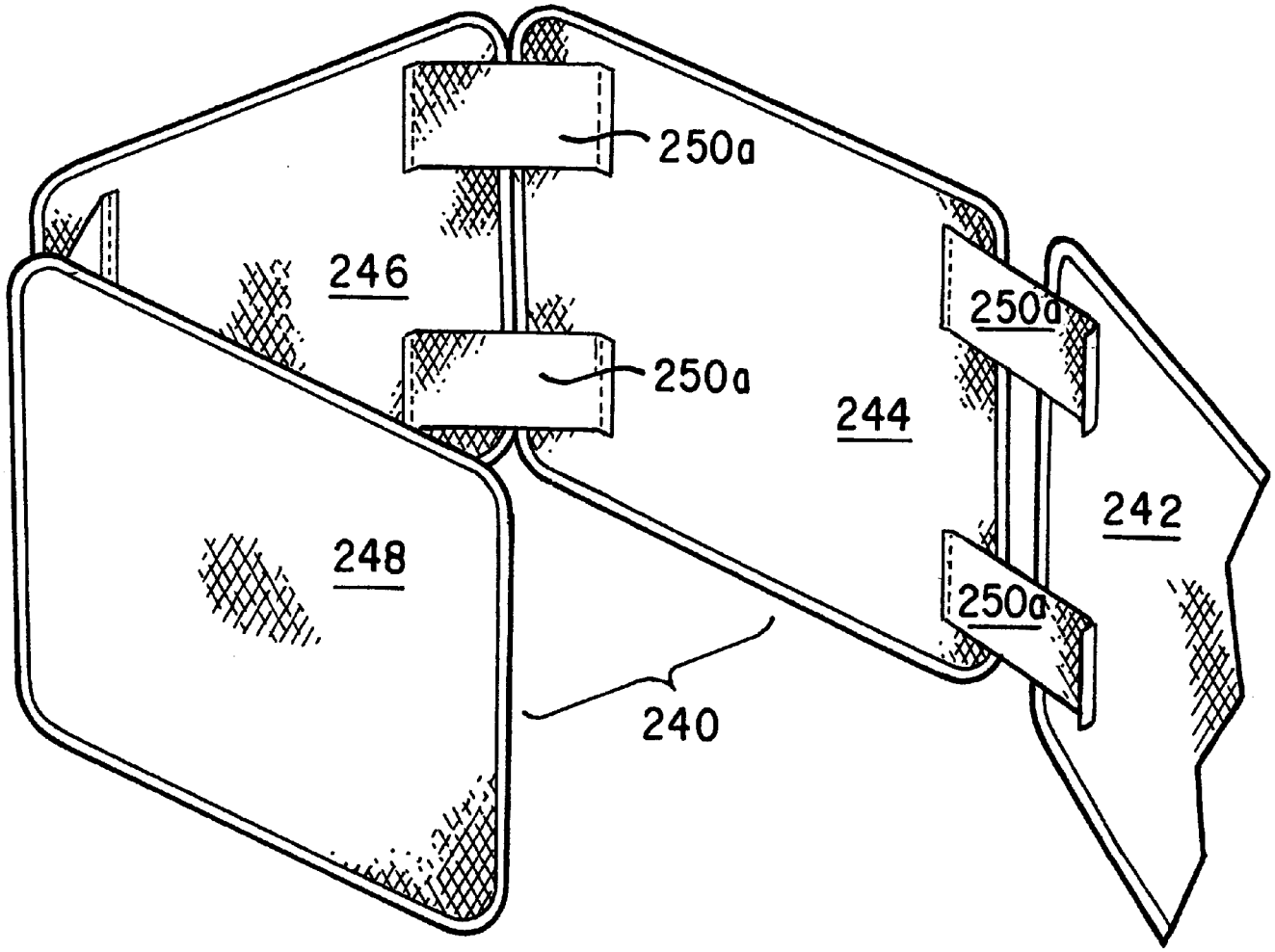

The principles illustrated in FIGS. 16A–16D can be utilized to provide added utility to a collapsible structure 240, as illustrated in FIGS. 17A–17C. The collapsible structure 240 can be made up of four panels 242, 244, 246, 248, each configured as panels 202, 204, with each panel 242, 244, 246 or 248 coupled by connectors 250 in the same manner illustrated in FIGS. 16A–16D. Connectors 250 can be made from the same materials as connector 212. As shown in FIG. 17A, a four-sided structure 240 is formed by applying the connectors 250 to the interior surfaces or sides of the panels 242, 244, 246, 248, so that the connectors 250 are not visible from the exterior. As an alternative, FIG. 17B illustrates a four-sided structure 240 formed by applying the connectors 250 to the exterior surfaces or sides of the panels 242, 244, 246, 248.

The structure 240 can be folded and collapsed using the same principles illustrated in U.S. Pat. No. 5,560,385 for similar four-sided enclosing structures. Alternatively, at least one of the connectors 250 can be detached to separate two panels, such as 242 and 248, and then the four panels 242, 244, 246, 248 folded one on top of each other to create a stack of four panels that are folded and collapsed according to FIGS. 5A–5D above. As a further alternative, all the connectors 250 can be detached to separate all the panels 242, 244, 246, 248, and then the four separated panels 242, 244, 246, 248 can be placed one on top of each other to create a stack of four panels that are folded and collapsed according to FIGS. 5A–5D above.

FIG. 17C illustrates a modification to the structure 240, where instead of using a single connector 250 to couple two adjacent panels, a plurality of connectors 250*a* is used to couple two adjacent panels. Even though FIG. 17C illustrates the connectors 250*a* applied to the interior surfaces or sides of the panels 242, 244, 246, 248, it is also possible to apply the connectors 250 to the exterior surfaces or sides of the panels 242, 244, 246, 248. Each of these connectors 250*a* can therefore be provided with corresponding detachable attachment devices, and each panel 242, 244, 246, 248 can also have its corresponding detachable attachment devices for engagement with the detachable attachment devices of the connectors 250*a*. Alternatively, detachable attachment devices are not needed at the edges of connectors 250*a* that are permanently attached to a corresponding panel.

Figure 18:
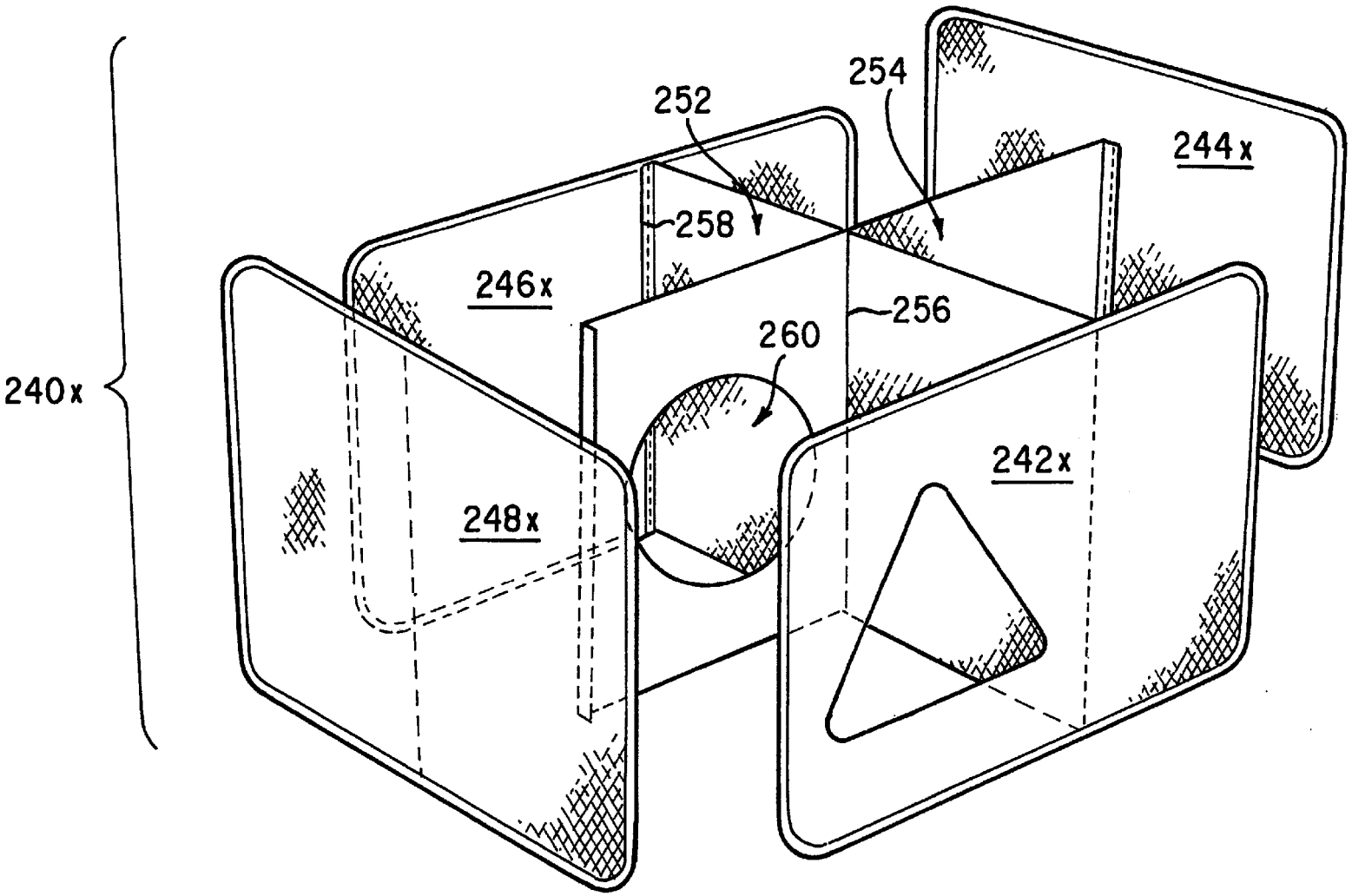
FIG. 18 is a perspective view of a collapsible object according to yet a further embodiment of the present invention shown in use in its expanded configuration.

The structure 240*x* in FIG. 18 borrows from the principles illustrated in FIG. 16D, where the connectors are positioned at about the center of the panels 242*x*, 244*x*, 246*x*, 248*x*. Here, two connectors 252 and 254 are provided and disposed perpendicular to each other in a "+" configuration. Connectors 252, 254 can be made from the same materials as connector 212. Each connector 252 and 254 can be comprised of two pieces of material, so that the center of inner edges of the four total pieces can be attached (e.g., by stitching 256) at the center so that the connectors 252, 254 essentially intersect each other. The outer edges (e.g., 258) of each connector piece can either be permanently or non-permanently (i.e., using detachable attachment devices) attached to the fabric of one panel 242*x*, 244*x*, 246*x* or 248*x*. Alternatively, one connector (e.g., 252) can be provided as one piece of material, with the other connector (e.g., 254) provided in two pieces of material with the center edges of the two pieces stitched to the one piece of connector 252. Thus, the connectors 252, 254 can function as dividers or walls inside the enclosed space defined by the panels 242*x*, 244*x*, 246*x*, 248*x*. Openings 260 can be provided in one or more of the connectors 252, 254 to allow passage from one interior space to another.

The structure 240*x* can be folded and collapsed by detaching at least one edge 258 of one of the connectors 252 or 254, and then placing the four panels 242*x*, 244*x*, 246*x*, 248*x* one on top of each other (with the connectors 252, 254 tucked between any two panels) to create a stack of four panels that are folded and collapsed according to FIGS. 5A–5D above.

Figure 19:
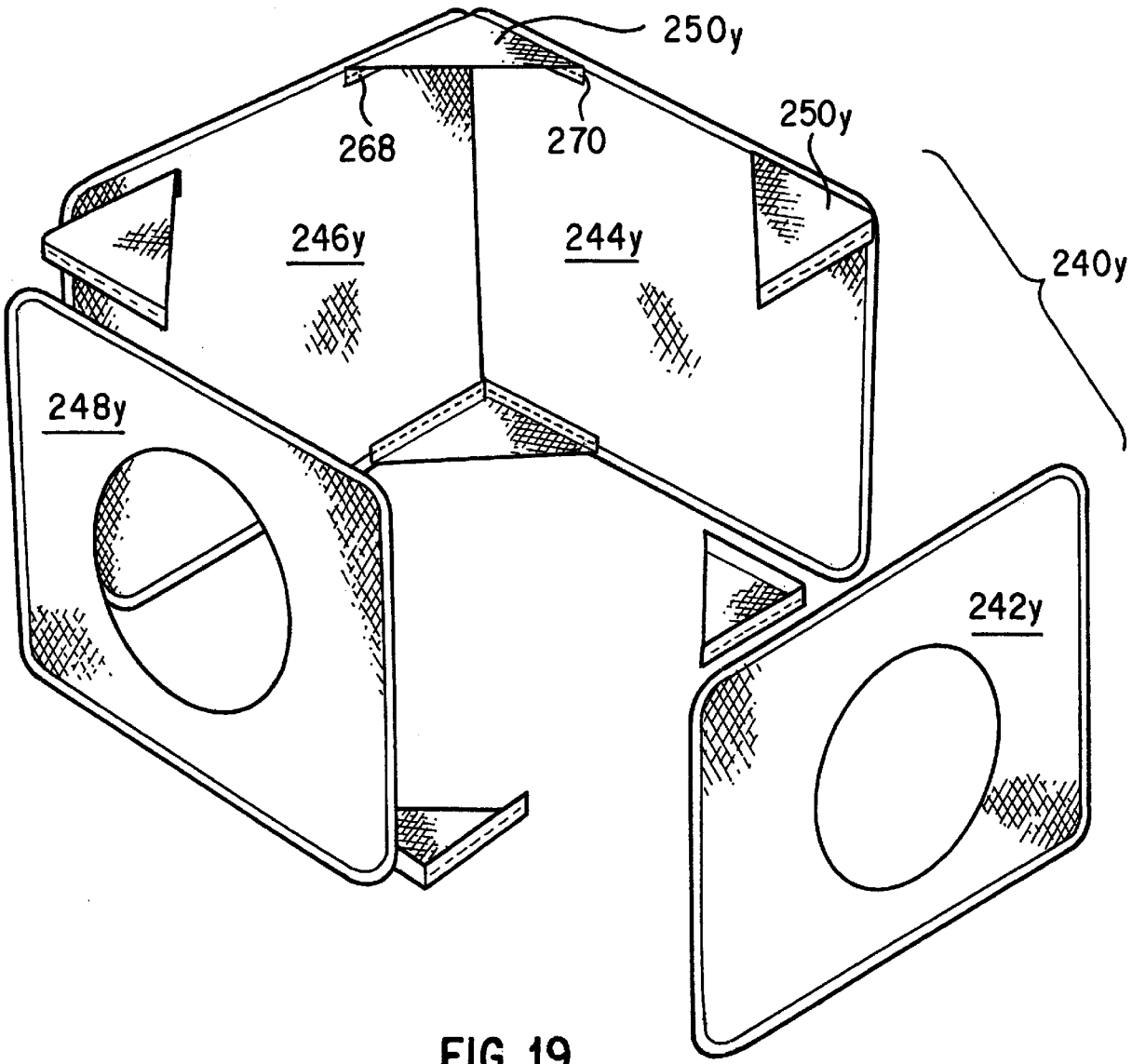
FIG. 19 is a perspective view of the object of FIG. 17C illustrating modifications made thereto.

The structure 240*y* of FIG. 19 borrows from the principles illustrated in FIG. 17C, where the connectors now take the form of corner pieces 250*y* that can be made from the same materials as connector 212. Each corner piece 250*y* can be provided in a generally triangular shape, although any other shape can be used. One side 268 of the corner piece 250*y* can be permanently (e.g., by stitching) or non-permanently (i.e., using detachable attachment devices) attached to the fabric of one panel (such as 246*y*) while another side 270 of the same corner piece 250*y* can be permanently or non-permanently attached to the fabric of an adjacent panel (such as 244*y*). One or more corner pieces 250*y* can be used to couple two adjacent panels 242*y*, 244*y*, 246*y*, 248*y*. The piece of material that makes up the corner piece 250*y* can be disposed generally perpendicular to the panels.

Thus, the present invention provides collapsible objects and structures having at least two panels that have interacting and corresponding adjustable attachment mechanisms that function both to couple the panels to each other, and to allow relative positions of the panels to be adjusted to change the size and configuration of the object or structure. This increases the number of applications in which the collapsible objects and structures can be used, and adds to the fun and variety of these objects and structures.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a first panel and a second panel, each panel having:

a foldable frame member that has a folded and an unfolded orientation, a material covering portions of the frame member when the frame member is in the unfolded orientation with the material assuming the unfolded orientation of its associated frame member;

a side edge, and an opening provided along the side edge; and a connector that is fitted through the openings of the first and second panels to couple the first and second panels in a manner that allows the relative positions of the first and second panels to be adjusted.

2. The structure of claim 1, wherein the connector is a sleeve that encloses portions of the side edges of the first and second panels.

3. The structure of claim 1, wherein the connector is a ring that grips the side edges of the first and second panels.

4. A collapsible structure, comprising:

a first panel and a second panel, each panel having a foldable frame member that has a folded and an unfolded orientation, and a material covering portions of the frame member when the frame member is in the unfolded orientation with the material assuming the unfolded orientation of its associated frame member; and a connector having first and second edges, with the first edge of the connector detachably attached to the first panel, and the second edge of the connector attached to the second panel.

5. The structure of claim 4, wherein the second edge of the connector is detachably attached to the second panel.

6. The structure of claim 4, wherein each of the first and second panels has a first surface and a second surface, and wherein the first edge of the connector is attached to the first surface of the first panel, and the second edge of the connector is attached to the first surface of the second panel.

7. The structure of claim 4, wherein each frame member is collapsible to the folded position by twisting and folding to form a plurality of concentric rings and layers of material to substantially reduce the size of each corresponding panel in the folded position.

8. The structure of claim 4, wherein each panel further includes a frame retaining sleeve provided along the material for retaining the respective frame member.

9. The structure of claim 4, further including:

a third panel having a foldable frame member that has a folded and an unfolded orientation, and a material covering portions of the frame member when the frame member is in the unfolded orientation with the material assuming the unfolded orientation of its associated frame member; and a second connector that couples the first and third panels in a manner that allows the relative positions of the first and third panels to be adjusted.

10. The structure of claim 9, further including:

a fourth panel having a foldable frame member that has a folded and an unfolded orientation, and a material covering portions of the frame member when the frame member is in the unfolded orientation with the material assuming the unfolded orientation of its associated frame member;

a third connector that couples the third and fourth panels in a manner that allows the relative positions of the third and fourth panels to be adjusted; and a fourth connector that couples the second and fourth panels in a manner that allows the relative positions of the second and fourth panels to be adjusted.

11. The structure of claim 9, wherein the connectors are corner pieces.

12. A collapsible structure, comprising:

a first panel and a second panel, each panel having a first surface, a second surface, a foldable frame member that has a folded and an unfolded orientation, and a material covering portions of the frame member when the frame member is in the unfolded orientation with the material assuming the unfolded orientation of its associated frame member; and a connector having first and second edges, with the first edge of the connector attached to the first surface of the first panel, and the second edge of the connector attached to the second surface of the second panel.

13. The structure of claim 12, wherein the first edge of the connector is detachably attached to the first panel.

14. A collapsible structure, comprising:

a first panel and a second panel, each panel having a foldable frame member that has a folded and an unfolded orientation, and a material covering portions of the frame member when the frame member is in the unfolded orientation, with the material assuming the unfolded orientation of its associated frame member; and a connector that couples the center of the first and second panels in a manner that allows the relative positions of the first and second panels to be adjusted.

15. The structure of claim 14, wherein the connector has a first edge that is detachably attached to the first panel.

16. The structure of claim 14, further including:

a third panel and a fourth panel, each having a foldable frame member that has a folded and an unfolded orientation, and a material covering portions of the frame member when the frame member is in the unfolded orientation with the material assuming the unfolded orientation of its associated frame member; and a second connector coupled to about the center of the third and fourth panels.

17. The structure of claim 16, wherein the two connectors intersect.

18. A collapsible structure, comprising:

a first panel and a second panel, each panel having a foldable frame member that has a folded and an unfolded orientation, and a material covering portions of the frame member when the frame member is in the unfolded orientation with the material assuming the unfolded orientation of its associated frame member; and a connector that couples the first and second panels in a manner that allows the relative positions of the first and second panels to be adjusted;

wherein the first panel has two openings provided spaced-apart from each other, and wherein the connector has a first end that is coupled to the second panel at a first location, and a second end that is inserted through the two openings of the first panel and is coupled to the second panel at a second location spaced apart from the first location.

* * * * *